US011388537B2

(12) United States Patent
Patil

(10) Patent No.: US 11,388,537 B2
(45) Date of Patent: Jul. 12, 2022

(54) CONFIGURATION OF AUDIO REPRODUCTION SYSTEM

(71) Applicant: SONY CORPORATION, Tokyo (JP)

(72) Inventor: Sharanappagouda Patil, Bangalore (IN)

(73) Assignee: SONY CORPORATION, Tokyo (JP)

( * ) Notice: Subject to any disclaimer, the term of this patent is extended or adjusted under 35 U.S.C. 154(b) by 0 days.

(21) Appl. No.: 17/076,219

(22) Filed: Oct. 21, 2020

(65) Prior Publication Data

US 2022/0124447 A1 Apr. 21, 2022

(51) Int. Cl.
*H04S 7/00* (2006.01)

(52) U.S. Cl.
CPC ..... *H04S 7/302* (2013.01)

(58) Field of Classification Search
CPC .... G10L 19/008; G10L 19/22; H04S 2400/11; H04S 2420/03; H04S 7/30; H04S 2420/11; H04S 7/301; H04S 7/303
USPC ..... 381/310, 22, 306, 307, 303
See application file for complete search history.

(56) References Cited

U.S. PATENT DOCUMENTS 7,113,609 B1 * 9/2006 Neidich ..... H04R 5/02 381/103
9,980,076 B1 5/2018 Pratt et al.
10,225,656 B1 * 3/2019 Kratz ..... G06F 3/011
10,321,255 B2 6/2019 Shimada
2003/0081115 A1 * 5/2003 Curry ..... H04R 27/00 348/14.12
2006/0062398 A1 3/2006 McKee Cooper et al.
2006/0078129 A1 * 4/2006 Nakamichi ..... H04S 7/303 381/18
2017/0086008 A1 * 3/2017 Robinson ..... H04S 7/30
2018/0109900 A1 * 4/2018 Lyren ..... H04S 7/304
2018/0376268 A1 12/2018 Kerdranvat et al.
2019/0075418 A1 * 3/2019 Shi ..... G06T 7/73
2019/0253801 A1 * 8/2019 Arteaga ..... H04R 5/027
2019/0253824 A1 8/2019 Maher et al.
2019/0313200 A1 * 10/2019 Stein ..... G06F 3/04815
2020/0275233 A1 * 8/2020 Mason ..... H04R 3/04

FOREIGN PATENT DOCUMENTS

WO 2016/099821 A1 6/2016

* cited by examiner

*Primary Examiner* — Alexander Krzystan
(74) *Attorney, Agent, or Firm* — Chip Law Group

(57) ABSTRACT

An electronic apparatus and method for configuration of an audio reproduction system is provided. The electronic apparatus receives image of a listening environment and applies a machine learning model on the image to identify a plurality of objects, including a display device and a plurality of audio devices. The electronic apparatus determines contour information of each identified object. The electronic apparatus retrieves real-dimension information of each identified object. Based on the determined contour information and the retrieved real-dimension information, the electronic apparatus determines first distance information between a listening position and each identified object. The electronic apparatus receives an audio signal from each audio device and determines a second distance between each audio device and the listening position based on the received audio signal. The electronic apparatus determines an anomaly in connection of at least one audio device and generates connection information based on the determined anomaly.

18 Claims, 10 Drawing Sheets

CONFIGURATION OF AUDIO REPRODUCTION SYSTEM

CROSS-REFERENCE TO RELATED APPLICATIONS/INCORPORATION BY REFERENCE

None.

FIELD

Various embodiments of the disclosure relate to surround sound technology. More specifically, various embodiments of the disclosure relate to a system and method for connection and configuration of an audio reproduction system.

BACKGROUND

With advancements in surround sound technology, various configurations of multi-channel surround sound audio systems have gained popularity. Some of the configurations include, for example, 2.1 configuration, a 5.1 configuration, or a 7.1 configuration. Typically, a surround sound system may come with a setup manual or an automatic configuration option to configure the surround sound system(s) and achieve a required sound quality. Unfortunately, in many instances, settings determined for the surround sound system by use of the setup manual or the automatic configuration option may not always be accurate and may not even produce a suitable sound quality.

Further limitations and disadvantages of conventional and traditional approaches will become apparent to one of skill in the art, through comparison of described systems with some aspects of the present disclosure, as set forth in the remainder of the present application and with reference to the drawings.

SUMMARY

An electronic apparatus and a method for configuration of an audio reproduction system is provided substantially as shown in, and/or described in connection with, at least one of the figures, as set forth more completely in the claims.

These and other features and advantages of the present disclosure may be appreciated from a review of the following detailed description of the present disclosure, along with the accompanying figures in which like reference numerals refer to like parts throughout.

DETAILED DESCRIPTION

The following described implementations may be found in the disclosed electronic apparatus and method for connection and configuration of an audio reproduction system. Exemplary aspects of the disclosure provide an electronic apparatus that may determine an anomaly in connection of audio devices of the audio reproduction system and generate connection or configuration information based on the determined anomaly to correct the anomaly and/or to calibrate the audio devices. The disclosed electronic apparatus relies on images of a listening environment to identify different audio devices (e.g., Left, Right, center, surround left, surround right, etc.) with respect to a user or a listener irrespective of a position of audio devices in the listening environment. The disclosed electronic apparatus also allows detection of wrong connection of audio devices to their Audio-Video Receiver (AVR) and missing connection of one or more audio devices to the AVR based on distance information between a listening position in the listening environment and each identified audio device. In an embodiment, the electronic apparatus may control an image-capture device (i.e. single camera) and an audio capturing device (such as mono-microphone) to determine distance information (for example absolute distance) between the listening position and each identified audio device. In an embodiment, the disclosed electronic device may determine the distance information based on a single image of the listening environment captured by the image-capture device and audio samples captured from the audio devices by the audio capturing device. The electronic device may determine anomaly in connection of audio devices, based on the determined distances based on the captured image and audio samples. The electronic device may also determine an elevation angle between the listening position and an audio device which may be positioned at a defined height from the listening position in the listening environment. In an embodiment, the electronic device may further determine height differences between multiple audio devices, and further control audio reproduction of multiple audio devices, using head-related transfer function (HRTF). Additionally, the disclosed electronic apparatus categorizes the listening environment into a specific type and also the objects in it using machine learning models, e.g., a pre-trained neural network model. The disclosed electronic apparatus may also allow creation of a room map, on which the user can tap to indicate his/her position to calibrate the audio devices to that listening position.

Figure 1:
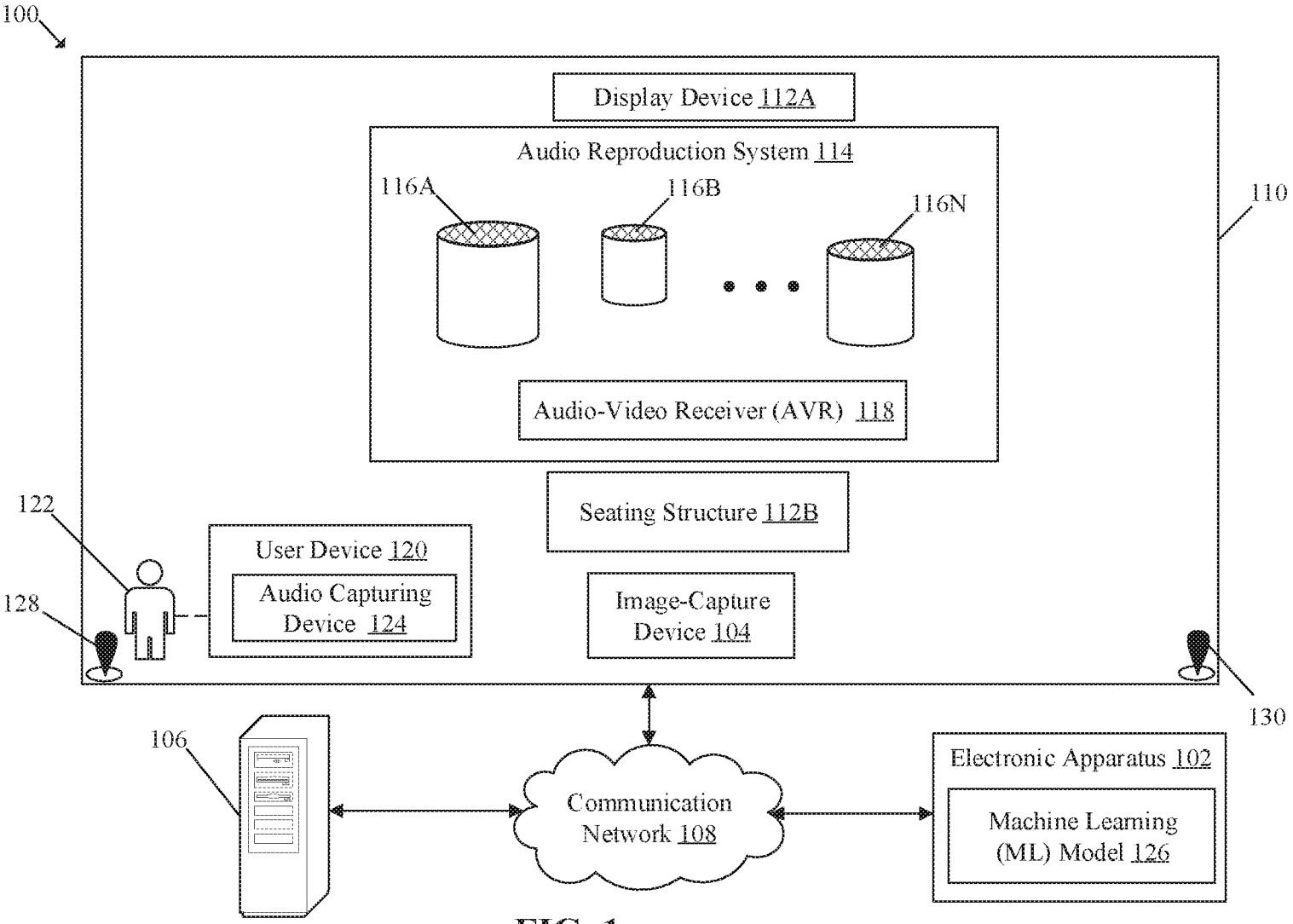
FIG. 1 is a diagram that illustrates an exemplary environment for configuration of an audio reproduction system, in accordance with an embodiment of the disclosure.

FIG. 1 is a diagram that illustrates an exemplary environment for configuration of an audio reproduction system, in accordance with an embodiment of the disclosure. With reference to FIG. 1, there is shown a network environment 100. The network environment 100 may include an electronic apparatus 102, an image-capture device 104, a server 106, and a communication network 108. The electronic apparatus 102 may be communicatively coupled to the server 106, via the communication network 108. In FIG. 1, the electronic apparatus 102 and the image-capture device 104 are shown as two separate devices; however, in some embodiments, the entire functionality of the image-capture device 104 may be incorporated in the electronic apparatus 102, without a deviation from scope of the disclosure. There is further shown a listening environment 110 which includes a display device 112A, a seating structure 112B, and an audio reproduction system 114. The audio reproduction system 114 may include a plurality of audio devices 116A, 116B . . . 116N.

There is further shown an Audio-Video Receiver (AVR) 118 and a user device 120 associated with a user 122. The AVR 118 may be a part of the audio reproduction system 114. There is further shown an audio capturing device 124 that may be a part of the user device 120. As shown in FIG. 1, the electronic apparatus 102 may further include a machine learning (ML) model 126. The electronic apparatus 102 is shown outside the listening environment 110; however, in some embodiments, the electronic apparatus 102 may be inside the listening environment 110, without a deviation from scope of the disclosure. Further, the electronic apparatus 102 and the user device 120 are shown as separate devices, however, in some embodiments, the entire functionality of the electronic apparatus 102 may be incorporated in the user device 120, without a deviation from scope of the disclosure.

The electronic apparatus 102 may comprise suitable logic, circuitry, and interfaces that may be configured to determine an anomaly in connection of one or more audio devices of the plurality of audio devices 116A-116N and generate connection information associated with the plurality of audio devices 116A-116N based on the determined anomaly in the connection. Such connection information may be used to reconfigure or calibrate the audio reproduction system 114 and may include a plurality of fine-tuning parameters, such as, but not limited to, a delay parameter, a level parameter, an equalization (EQ) parameter, an audio device layout, room environment information, or the determined anomaly in the connection of the one or more audio devices 116A-116N. Examples of the electronic apparatus 102 may include, but are not limited to, a server, a media production system, a computer workstation, a mainframe computer, a handheld computer, a mobile phone, a smart appliance, and/or other computing device with image processing capability. In at least one embodiment, the electronic apparatus 102 may be a part of the audio reproduction system 114.

The image-capture device 104 may comprise suitable logic, circuitry, and interfaces that may be configured to capture images of the listening environment 110. The images may include a plurality of objects in a field-of-view (FOV) region of the image-capture device 104. Examples of implementation of the image-capture device 104 may include, but are not limited to, an active pixel sensor, a passive pixel sensor, a wide-angle camera, an action camera, a closed-circuit television (CCTV) camera, a camcorder, a time-of-flight camera (ToF camera), a night-vision camera, a smartphone, a digital camera, and/or other image capture devices. In an image-capturing device 104 may include one image sensor, and may not correspond to a stereo camera or imaging device.

The server 106 may comprise suitable logic, circuitry, and interfaces that may be configured to act as a store for the images and a Machine Learning (ML) model 126. In some embodiments, the server 106 may be also responsible for training of the ML model 126 and therefore, may be configured to store training data for the ML model 126. In certain instances, the server 106 may be implemented as a cloud server which may execute operations through web applications, cloud applications, HTTP requests, repository operations, file transfer, and the like. Other example implementations of the server 106 may include, but are not limited to, a database server, a file server, a web server, a media server, an application server, a mainframe server, or other types of servers.

In certain embodiments, the server 106 may be implemented as a plurality of distributed cloud-based resources by use of several technologies that are well known to those skilled in the art. A person with ordinary skill in the art will understand that the scope of the disclosure may not be limited to implementation of the server 106 and the electronic apparatus 102 as separate entities. Therefore, in certain embodiments, functionalities of the server 106 may be incorporated in its entirety or at least partially in the electronic apparatus 102, without a departure from the scope of the disclosure.

The communication network 108 may include a communication medium through which the electronic apparatus 102, the image-capturing device 104, the server 106, the display device 112A, the audio reproduction system 114, the user device 120, and/or certain objects in the listening environment 110 may communicate with each other. In some embodiments, the communication network 108 may include a communication medium through which the electronic apparatus 102, the image-capture device 104, the user device 120, and the audio reproduction system 114 may communicate with each other.

The communication network 108 may be a wired or wireless communication network. Examples of the communication network 108 may include, but are not limited to, the Internet, a cloud network, a Wireless Fidelity (Wi-Fi) network, a Personal Area Network (PAN), a Local Area Network (LAN), or a Metropolitan Area Network (MAN). Various devices in the network environment 100 may be configured to connect to the communication network 108, in accordance with various wired and wireless communication protocols. Examples of such wired and wireless communication protocols may include, but are not limited to, at least one of a Transmission Control Protocol and Internet Protocol (TCP/IP), User Datagram Protocol (UDP), Hypertext Transfer Protocol (HTTP), File Transfer Protocol (FTP), Zig Bee, EDGE, IEEE 802.11, light fidelity (Li-Fi), 802.16, IEEE 802.11s, IEEE 802.11g, multi-hop communication, wireless access point (AP), device to device communication, cellular communication protocols, and Bluetooth (BT) communication protocols.

The listening environment 110 may be a built environment or a part of the built environment. The listening environment 110 may include a plurality of objects, for example, audio devices, display device(s), seating structure(s), and the like. Examples of listening environment 110 may include, but is not limited to, a living room, a listening room, a bedroom, a home theatre, a concert hall, a recording studio, an auditorium, a cinema hall, a gaming room, and a meeting room.

The display device 112A may comprise suitable logic, circuitry, and interfaces that may be configured to display media content. The display device 112A may be placed (or mounted) on a wall in the listening environment 110. Alternatively, the display device 112A may be placed on (or affixed to) a support (for example, a table or a stand) in the listening environment 110. In certain embodiments, the display device 112A may be placed (or mounted) at the center of a wall and in front of the seating structure 112B in the listening environment 110. Example of the display device 112A, may be, but not limited to, a television, a display monitor, a digital signage, and/or other computing devices with a display screen.

The audio reproduction system 114 may comprise suitable logic, circuitry, and interfaces that may be configured to control playback of audio content, via the plurality of audio devices 116A-116N. The audio content may be, for example, a 3D audio, a surround sound audio, a positional audio, and the like. The audio reproduction system 114 may be any M: N surround sound system, where "M" may represent a number of speakers and "N" may represent a number of sub-woofers. Examples of the M: N surround sound system may include, but not limited to, 2:1 surround system, 3:1 surround system, 5:1 surround system, 7:1 surround system, 10:2 surround system, and 22:2 surround system. As an example, the audio reproduction system 114 may be a 5:1 surround system which includes 5 speakers, i.e., a center speaker, a left speaker, a right speaker, a surround left speaker, a surround right speaker and a subwoofer.

The plurality of audio devices 116A-116N include same or different types of speakers placed in accordance with a layout (e.g., a 5:1 layout) in the listening environment 110. The plurality of audio devices 116A-116N may be connected to the AVR 118, via a wired or a wireless connection. The placement of the plurality of audio devices 116A-116N may be based on a placement of certain objects, such as the display device 112A and/or a seating structure 112B (e.g., a sofa) in the listening environment 110. The plurality of audio devices 116A-116N may receive the audio content from the AVR 118 or the user device 120 for audio reproduction in the listening environment 110.

The AVR 118 may comprise suitable logic, circuitry, and interfaces that may be configured to drive the plurality of audio devices 116A, 116B . . . 116N communicatively coupled to the AVR 118. Additionally, the AVR 118 may receive tuning parameters from the electronic apparatus 102 and configure each of the plurality of audio devices 116A-116N based on the tuning parameters. Examples of the tuning parameters may include, but are not limited to, a delay parameter, a level parameter, and an EQ parameter. The AVR 118 may be, for example, an electronic driver of the audio reproduction system 114. Other examples of the AVR 118 may include, but are not limited to, a smartphone, a laptop, a tablet computing device, a wearable computing device, or any other portable computing device.

The user device 120 may comprise suitable logic, circuitry, and interfaces that may be configured to record an audio signal from each of the plurality of audio devices 116A-116N. The audio signal may of a specific duration (for example, "5 seconds"), a specific frequency, or a sound pattern. The user device 120 may be further configured to transmit the recorded audio signal to the electronic apparatus 102, via the communication network 108. Examples of the user device 120 may include, but are not limited to, a smartphone, a mobile phone, a laptop, a tablet computing device, a computer workstation, a wearable computing device, or any other computing device with audio recording capability. In some embodiments, the user device 120 may include the image-capturing device 104 to capture the images of the listening environment 110. The user device 120 may be associated or owned by the user 122 (such as a listener in the listening environment 110).

The audio capturing device 124 may include suitable logic, circuitry, and/or interfaces that may be configured to capture the audio signal from each of the plurality of audio devices 116A-116N. The audio capturing device 124 may be further configured to convert the captured audio signal into an electrical signal. In an embodiment, the audio capturing device 124 may be a mono-microphone of the user device 120. Examples of the audio capturing device 124 may include, but are not limited to, a recorder, an electret microphone, a dynamic microphone, a carbon microphone, a piezoelectric microphone, a fiber microphone, a (micro-electro-mechanical-systems) MEMS microphone, or other microphones known in the art.

The ML model 126 may be an object detector model, which may be trained on an object detection task or classification task on at least one image of a listening environment (such as, the listening environment 110). The ML model 126 may be pre-trained on a training dataset of different object types typically present in the listening environment 110. The ML model 126 may be defined by its hyper-parameters, for example, activation function(s), number of weights, cost function, regularization function, input size, number of layers, and the like. The hyper-parameters of the ML model 126 may be tuned and weights may be updated before or while training the ML model 126 on a training data set so as to identify a relationship between inputs, such as features in a training dataset and output labels, such as different objects e.g., a display device, an audio device, a seating structure, or a user. After several epochs of the training on the feature information in the training dataset, the ML model 126 may be trained to output a prediction/classification result for a set of inputs. The prediction result may be indicative of a class label for each input of the set of inputs (e.g., input features extracted from new/unseen instances). For example, the ML model 126 may be trained on several training images of objects to predict result, such as the objects present in the listening environment 110.

In an embodiment, the ML model 126 may include electronic data, which may be implemented as, for example, a software component of an application executable on the electronic apparatus 102. The ML model 126 may rely on libraries, external scripts, or other logic/instructions for execution by a processing device, such as the electronic apparatus 102. The ML model 126 may include computer-executable codes or routines to enable a computing device, such as the electronic apparatus 102 to perform one or more operations to detect objects in input images. Additionally, or alternatively, the ML model 126 may be implemented using hardware including a processor, a microprocessor (e.g., to perform or control performance of one or more operations), a field-programmable gate array (FPGA), or an application-specific integrated circuit (ASIC). For example, an inference accelerator chip may be included in the electronic apparatus 102 to accelerate computations of the ML model 126 for the object detection task. In some embodiments, the ML model 126 may be implemented using a combination of both hardware and software. Examples of the ML model 126 may include, but are not limited to, a neural network model or a model based on one or more of regression method(s), instance-based method(s), regularization method(s), decision tree method(s), Bayesian method(s), clustering method(s), association rule learning, and dimensionality reduction method(s).

Examples of the ML model 126 may include, but are not limited to, a deep neural network (DNN), a convolutional neural network (CNN), a recurrent neural network (RNN), a CNN-recurrent neural network (CNN-RNN), R-CNN, Fast R-CNN, Faster R-CNN, an artificial neural network (ANN), (You Only Look Once) YOLO network, a Long Short Term Memory (LSTM) network based RNN, CNN+ANN, LSTM+ANN, a gated recurrent unit (GRU)-based RNN, a fully connected neural network, a Connectionist Temporal Classification (CTC) based RNN, a deep Bayesian neural network, a Generative Adversarial Network (GAN), and/or a combination of such networks. In some embodiments, the ML model 126 may include numerical computation techniques using data flow graphs. In certain embodiments, the ML model 126 may be based on a hybrid architecture of multiple Deep Neural Networks (DNNs).

In operation, an input may be provided to the electronic apparatus 102 as a request to calibrate the plurality of audio devices 116A-116N and/or reconfigure the plurality of audio devices 116A-116N based on tuning parameters for the plurality of audio devices 116A-116N. Additionally, or alternatively, the request may be for a detection of an anomaly in connection of one or more audio devices of the audio reproduction system 114. Such an input may be provided, for example, as a user input via the user device 120 and may be, for example, a result of a user's intention to improve a sound quality of the audio reproduction system 114, or to detect and correct the anomaly in the connection of one or more audio devices of the audio reproduction system 114 or to improve a sound quality based on difference of heights between the plurality of audio devices 116A-116N.

By way of example, based on the input, the electronic apparatus 102 may be configured to communicate to the user device 120, a request for images (at least one image) of the listening environment 110. The request may be an application instance which prompts the user 122 to upload the at least one image of the listening environment 110. In at least one embodiment, the electronic apparatus 102 may be configured to control the image-capture device 104 to capture the at least one image of the listening environment 110. Alternatively, the at least one image may be captured by the image-capture device 104 based on a user input. The at least one image may include, for example, a first image from a first viewpoint 128 and/or a second image from the second viewpoint 130 of the listening environment 110.

In another embodiment, the image-capture device 104 may be configured to share the captured at least one image (such as the first image and/or the second image) with the electronic apparatus 102. Alternatively, the captured at least one image may be shared with the server 106, via an application interface on the user device 120. In some embodiments, where the image-capturing device 104 may be integrated in the user device 120, the user device 120 may capture the first image from the first viewpoint 128 and/or the second image from the second viewpoint 130 of the listening environment 110.

The electronic apparatus 102 may be configured to receive the captured at least one image. The received at least one image may include a plurality of objects, as present in the listening environment 110. For example, the plurality of objects may include the display device 112A, a seating structure 1128 (for example a sofa, a chair, or a bed), and the plurality of audio devices 116A-116N of the audio reproduction system 114. Details about the reception or acquisition on the captured image are provided, for example, at FIG. 3 (at 302).

The electronic apparatus 102 may be further configured to identify the plurality of objects in the received at least one image. The plurality of objects may be identified based on application of the ML model 126 on the received at least one image. The electronic apparatus 102 may be further configured to determine a type of the listening environment 110 based on further application of an ML model 126 on the identified plurality of objects. The type of listening environment may be, for example, a living room, a recording room, a concert hall, and the like. The ML model 126 used for the determination of the type of the listening environment 110 may be same or different from that used for the identification of the plurality of objects. The ML model 126 may be pre-trained on a training dataset of different object types typically present in any listening environment.

The electronic apparatus 102 may be further configured to determine contour information of each of the identified plurality of objects (such as the display device 112A, the seating structure 1128, and the plurality of audio devices 116A-116N) in the received at least one image. The contour information may include at least one of height information (in pixels) or width information (in pixels) of each of the identified plurality of objects in the received at least one image. In general, the contour of an object in an image may represent a boundary or an outline of the object and may be used to localize the object in the image. Details about the application of the ML model 126 are provided, for example, at FIG. 3 (at 304 and 306).

The electronic apparatus 102 may be further configured to retrieve real-dimension information (i.e. real dimensions in one of centimeter, inches, yards, or meters) of each of the identified plurality of objects. In an embodiment, the real-dimension information may be retrieved from the server 106 or from the user device 120. The electronic apparatus 102 may be configured to determine first distance information between a listening position (such as location of the user 122 or the user device 120) in the listening environment 110 and each of the identified plurality of objects (such as the display device 112A, the seating structure 1128, and the plurality of audio devices 116A-116N) based on the determined contour information and the retrieved real-dimension information of each of the identified plurality of objects. In an example, the listening position may correspond to a location of the first viewpoint 128 in the listening environment 110, from which the first image may be captured using the image-capturing device 104, as shown in FIG. 1. The details of the determination of the first distance information are provided, for example, in FIG. 3 (at 312) and 5A.

At any time instant, an audio signal from each of the plurality of audio devices 116A-116N may be recorded. Such an audio signal may include, for example, a test tone to be played by each of the plurality of audio devices 116A-116N. In certain embodiments, the user device 120 may include, for example, a mono-microphone to record the audio signal from each of the plurality of audio devices 116A-116N. The recorded audio signal from each audio device may be transmitted to the electronic apparatus 102, via the communication network 108.

Figure 3:
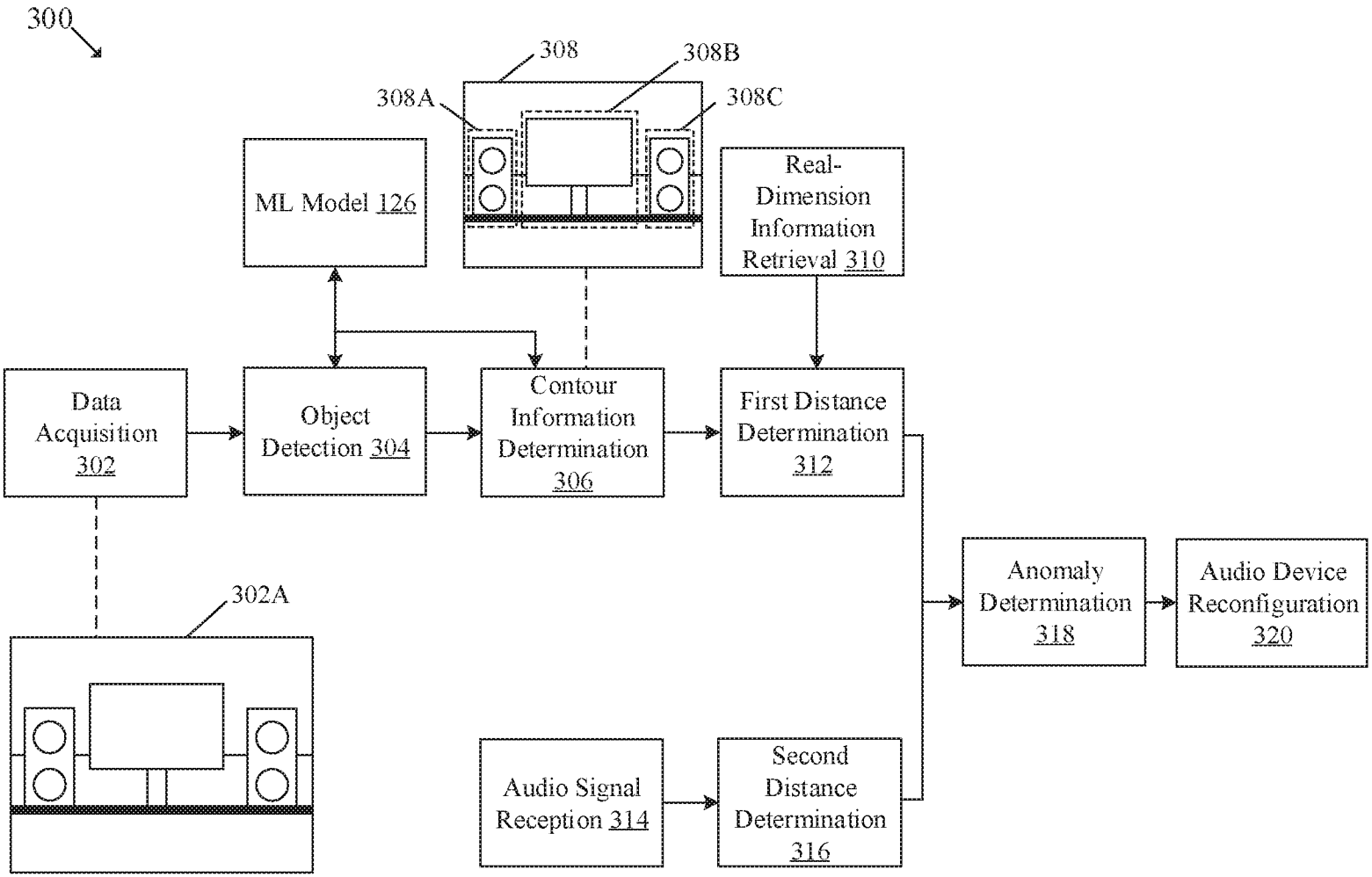
FIG. 3 is a diagram that illustrates exemplary operations for configuration of audio reproduction system, in accordance with an embodiment of the disclosure.
Figure 7:
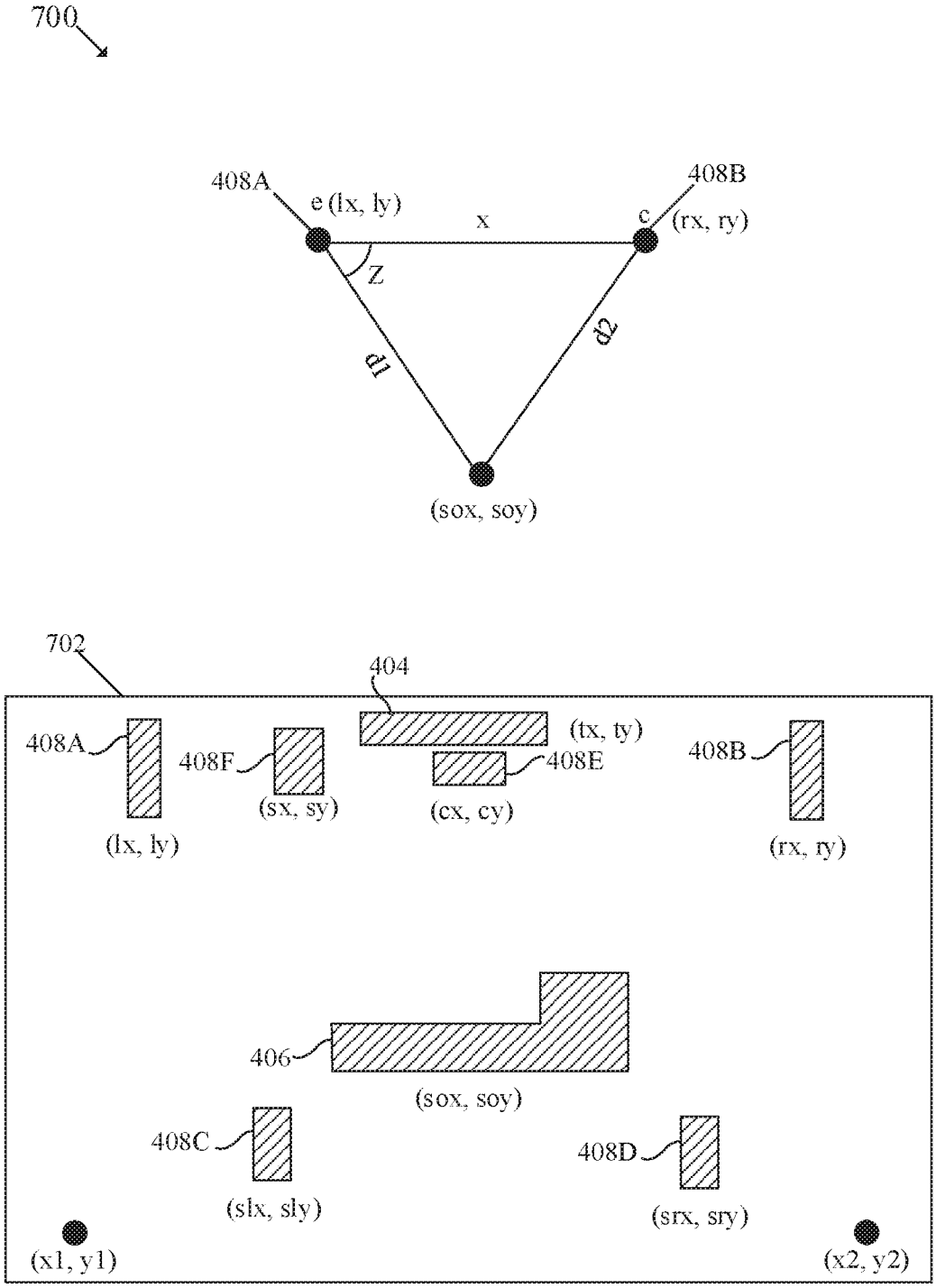
FIG. 7 is a diagram that illustrates exemplary determination of anomaly in connection of audio devices in an example layout of the audio devices, in accordance with an embodiment of the disclosure.

The electronic apparatus 102 may be configured to control the audio capturing device 124, at the listening position, to receive an audio signal from each of the plurality of audio devices 116A-116N and based on the received audio signal, determine second distance information between each of the plurality of audio devices 116A-116N and the listening position in the listening environment 110, as described further, for example, in FIGS. 3 and 7. In some instances, the user 122 may connect certain audio devices to incorrect channels on the AVR 118, for example, a left speaker connected to a channel for a right speaker, or vice versa. In some other instances, the user 122 may forget to connect one or more audio devices to their respective channels on the AVR 118. In both instances, the audio quality of the audio reproduction system 114 may be affected and the user 122 may not like the listening experience from audio played by the audio reproduction system 114. Thus, based on the determined first distance information and the determined second distance information, the electronic apparatus 102 may be configured to determine an anomaly in connection of at least one audio device of the plurality of audio devices 116A-116N. Such an anomaly may correspond to, for example, an incorrect connection or a missing connection of one or more audio devices with the AVR 118 of the audio reproduction system 114.

By way of example, for each audio device, the determined first distance (i.e. first distance information) may be compared with the determined second distance (i.e. second distance information) between the corresponding audio device and the listening position based on the received audio signal. In such instances, the anomaly in the connection may be determined based on whether the first distance (i.e. determined based on the captured image) between the corresponding audio device and the listening position is different from the determined second distance (i.e. determined based on received audio signals) between the corresponding audio device and the listening position. By way of another example, from a specific audio device, no audio signal may be received. In such cases, it may not be possible to determine the second distance between the specific audio device and the listening position based on the audio signal and the specific audio device may be classified as one of a disconnected or a malfunctioning device.

The electronic apparatus 102 may be further configured to generate connection information associated with the plurality of audio devices 116A-116N based on the determined anomaly in connection of at least one audio device of the plurality of audio devices 116A-116N. Such connection information may include, for example, instructions for the user 122 to correct the anomaly, messages which specify the anomaly, and location information of audio device(s) whose connections are found to be anomalistic. By way of example, the connection information may include information which details the anomaly and their respective solutions as a set of corrective measures to be followed by the user 122 to correct the anomaly.

The electronic apparatus 102 may be further configured to transmit the generated connection information to the user device 120. For example, the connection information may include a message, such as "The connection between a center audio device and the AVR is missing. Please connect the center audio device to the AVR" The user 122 may correct the connections based on the received connection information and therefore, enhance the listening experience of audio content played out by the audio reproduction system 114. Additionally, or alternatively, the electronic apparatus 102 may be configured to transmit the connection information to the AVR 118 so as to notify the audio reproduction system 114 about the anomaly in the connection of one or more audio devices.

In some embodiments, the electronic apparatus 102 may be further configured to generate configuration information for calibration of the plurality of audio devices 116A-116N based on one or more of: the determined anomaly in the connection, a layout of the plurality of audio devices 116A-116N in the listening environment 110, the listening position, and the generated connection information. The configuration information may include a plurality of fine-tuning parameters to enhance the listening experience of the user 122. The plurality of fine-tuning parameters may include, for example, a delay parameter, a level parameter, an EQ parameter, left/right audio device layout, room environment information, or the anomaly in the connection of the at least one audio device. The electronic apparatus 102 may be further configured to communicate the generated configuration information to the AVR 118 of the audio reproduction system 114. The AVR 118 may tune each of the plurality of audio devices 116A-116N of the audio reproduction system 114 based on the received configuration information.

In some embodiments, a camera device (not shown) may be present in the listening environment 110. For example, the camera device may be integrated with the display device 112A. The camera device may be configured to capture the image of the listening environment 110. The camera device may be further configured to transmit the captured image of the listening environment 110 to the electronic apparatus 102. The electronic apparatus 102 may be configured to receive the captured images of the listening environment 110 from the camera device and may be further configured to determine a change in the listening position relative to a position of the plurality of audio devices 116A-116N of the audio reproduction system 114. The electronic apparatus 102 may determine the change in the listening position relative to the position of the plurality of audio devices 116A-116N based on the user detection in the received image. The electronic apparatus 102 may be further configured to generate an updated configuration information based in the updated user location received in the image of the listening environment 110. The electronic apparatus 102 may be further configured to communicate the updated configuration information to the AVR 118 of the audio reproduction system 114. The AVR 118 may tune each of the plurality of audio devices 116A-116N of the audio reproduction system 114 based on the received updated configuration information.

Figure 2:
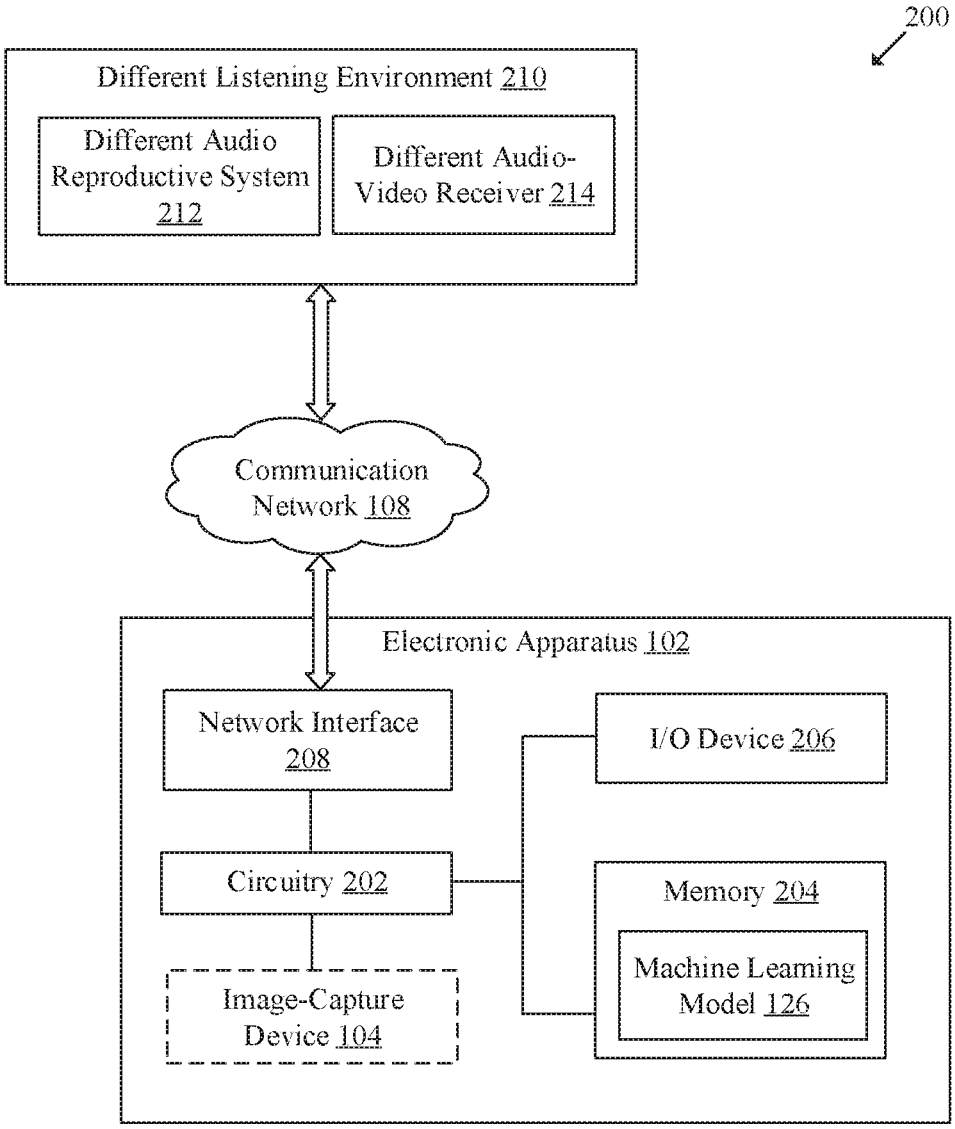
FIG. 2 is a block diagram that illustrates an exemplary electronic apparatus for configuration of an audio reproduction system, in accordance with an embodiment of the disclosure.

FIG. 2 is a block diagram that illustrates an exemplary electronic apparatus for configuration of an audio reproduction system, in accordance with an embodiment of the disclosure. FIG. 2 is explained in conjunction with elements from FIG. 1. With reference to FIG. 2, there is shown a block diagram 200 of the electronic apparatus 102. The electronic apparatus 102 may include circuitry 202, a memory 204, an input/output (I/O) device 206, and a network interface 208. With reference to FIG. 2, there is further shown a different audio reproduction system 212 in a different listening environment 210. The different audio reproduction system 212 may be communicatively coupled to the electronic apparatus 102, via the communication network 108. In certain instances, the electronic apparatus 102 may incorporate the functionality of an imaging device present in the listening environment 110 and therefore, may include the image-capture device 104. There is further shown the ML model 126.

The circuitry 202 may include suitable logic, circuitry, and interfaces that may be configured to execute instructions stored in the memory 204. The executed instructions may correspond to, for example, at least a set of operations for determination of an anomaly in connection of one or more audio devices of the plurality of audio devices 116A-116N based on the first distance information and the second distance information. The circuitry 202 may be implemented based on a number of processor technologies known in the art. Examples of the circuitry 202 may include, but are not limited to, a Graphical Processing Unit (GPU), a co-processor, a Central Processing Unit (CPU), x86-based processor, a Reduced Instruction Set Computing (RISC) processor, an Application-Specific Integrated Circuit (ASIC) processor, a Complex Instruction Set Computing (CISC) processor, and a combination thereof.

The memory 204 may include suitable logic, circuitry, and interfaces that may be configured to store the instructions to be executed by the circuitry 202. Also, the memory may be configured to store at least one image of the listening environment 110 and the ML model 126 (pre-trained) for recognition of objects in the at least one image. Examples of implementation of the memory 204 may include, but are not limited to, Random Access Memory (RAM), Read Only Memory (ROM), Electrically Erasable Programmable Read-Only Memory (EEPROM), Hard Disk Drive (HDD), a Solid-State Drive (SSD), a CPU cache, and/or a Secure Digital (SD) card.

The I/O device 206 may include suitable logic, circuitry, and/or interfaces that may be configured to act as an I/O channel/interface between the user 122 and the electronic apparatus 102. The I/O device 206 may include various input and output devices which may communicate with different operational components of the electronic apparatus 102. Examples of the I/O device 206 may include, but are not limited to, a touch screen, a keyboard, a mouse, a joystick, a microphone, and a display screen.

The network interface 208 may include suitable logic, circuitry, and/or interfaces that may be configured to facilitate communication between the electronic apparatus 102, the image-capturing device 104, the server 106, audio reproduction system 114, and the user device 120, via the communication network 108. The network interface 208 may be implemented by use of various known technologies to support wired or wireless communication of the electronic apparatus 102 with the communication network 108. The network interface 208 may include, but is not limited to, an antenna, a radio frequency (RF) transceiver, one or more amplifiers, a tuner, one or more oscillators, a digital signal processor, a coder-decoder (CODEC) chipset, a subscriber identity module (SIM) card, or a local buffer control circuitry.

The network interface 208 may be configured to communicate via wireless communication with networks, such as the Internet, an Intranet or a wireless network, such as a cellular telephone network, a wireless local area network (LAN), or a metropolitan area network (MAN). The wireless communication may use one or more of a plurality of communication standards, protocols and technologies, such as Global System for Mobile Communications (GSM), Enhanced Data GSM Environment (EDGE), wideband code division multiple access (W-CDMA), Long Term Evolution (LTE), code division multiple access (CDMA), time division multiple access (TDMA), Bluetooth, Wireless Fidelity (Wi-Fi) (such as IEEE 802.11a, IEEE 802.11b, IEEE 802.11g or IEEE 802.11n), voice over Internet Protocol (VoIP), light fidelity (Li-Fi), Worldwide Interoperability for Microwave Access (Wi-MAX), a protocol for email, instant messaging, and a Short Message Service (SMS).

The different listening environment 210 may be also a built environment or a part of the built environment. The different listening environment 210 may include a plurality of objects, for example, audio devices, display device(s), seating structure(s), and the like. Examples of the different listening environment 210 may include, but is not limited to, a living room, a listening room, a bedroom, a home theatre, a concert hall, a recording studio, an auditorium, a cinema hall, a gaming room, and a meeting room.

The different audio reproduction system 212 may include suitable logic, circuitry, and interfaces that may be configured to control playback of audio content, via a plurality of audio devices (not shown) in the different listening environment 210. The audio content may be, for example, a 3D audio, a surround sound audio, a positional audio, and the like. The different audio reproduction system 212 may be any M:N surround sound system, where "M" may represent a number of speakers and "N" may represent a number of sub-woofers. Examples of the M:N surround sound system may include, but not limited to, 2:1 surround system, 3:1 surround system, 5:1 surround system, 7:1 surround system, 10:2 surround system, and 22:2 surround system. As an example, the different audio reproduction system 212 may be a 5:1 surround system which includes 5 speakers, i.e., a center speaker, a left speaker, a right speaker, a surround left speaker, a surround right speaker and a subwoofer.

By way of example, and not limitation, the plurality of audio devices may include same or different types of speakers placed in accordance with a layout (e.g., a 5:1 layout) in the different listening environment 210. The plurality of audio devices may be connected to a different AVR 214, via a wired or a wireless connection. The placement of the plurality of audio devices may be based on a placement of certain objects, such as the display device and/or a seating structure (e.g., a sofa) in the different listening environment 210.

The different AVR 214 may include suitable logic, circuitry, and interfaces that may be configured to drive the plurality of audio devices of the different audio reproduction system 212 communicatively coupled to the different AVR 214. Additionally, or alternatively, the different AVR 214 may receive tuning parameters from the electronic apparatus 102 and configure each of the plurality of audio devices based on the tuning parameters. Examples of the tuning parameters may include, but are not limited to, a delay parameter, a level parameter, and an EQ parameter. The different AVR 214 may be, for example, an electronic driver of the different audio reproduction system 212. Other examples of the different AVR 214 may include, but are not limited to, a smartphone, a laptop, a tablet computing device, a wearable computing device, or any other portable computing device.

The functions or operations executed by the electronic apparatus 102, as described in FIG. 1, may be performed by the circuitry 202. Operations executed by the circuitry 202 are described in detail, for example, in the FIGS. 3, 4, 5A, 5B, 6, 7, 8, 9, and 10.

FIG. 3 is a diagram that illustrates exemplary operations for configuration of audio reproduction system, in accordance with an embodiment of the disclosure. FIG. 3 is explained in conjunction with elements from FIG. 1 and FIG. 2. With reference to FIG. 3, there is shown a block diagram 300 of exemplary operations from 302 to 320.

At 302, a data acquisition operation may be executed. In the data acquisition operation, the circuitry 202 may be configured to receive at least one image 302A of the listening environment 110, which may include a plurality of objects, for example, audio device(s), display device(s), seating structure(s), and the like. In certain instances, the image-capture device 104 may be controlled by the circuitry 202 to capture the at least one image (such as at least one image 302A shown in FIG. 3) of the listening environment 110 and to share the captured at least one image 302A with the electronic apparatus 102. Alternatively, the user 122 may setup the image-capture device 104 at one or more reference locations in the listening environment 110 to capture the at least one image 302A and to share the at least one image 302A with the electronic apparatus 102. The at least one image 302A may be captured in such a way that each object of the plurality of objects in the listening environment 110 is captured in the at least one image 302A. As an example, the at least one image 302A may include one or more audio devices (such as the plurality of audio devices 116A-116N), a display device (such as the display device 112A), and a seating structure (such as the seating structure 112B).

By way of example, the at least one image 302A may include a first image. which may be captured from the first viewpoint 128, of the listening environment 110. The first viewpoint may be, for example, a corner space of a room which is appropriately spaced apart from the audio reproduction system 114 so as to allow the image-capture device 104 to capture certain objects (including the audio reproduction system 114) in the at least one image 302A.

In another example, the at least one image 302A may include a first image and a second image which may be captured from the first viewpoint 128 and the second viewpoint 130 of the listening environment 110, respectively. The first and second viewpoints may be, for example, two corner spaces of a room which are appropriately spaced apart from each other and from the audio reproduction system 114 so as to allow the image-capture device 104 to capture certain objects (including the audio reproduction system 114) in the at least one image 302A. The number of images may depend upon certain factors, such as, but not limited to, a size of the listening environment 110, a number of objects in the listening environment 110, a number of objects in that appear in the field of view from a single viewpoint.

At 304, an object detection operation may be executed. In the object detection operation, the circuitry 202 may be configured to detect and identify the plurality of objects in the at least one image 302A. Such an identification may be performed based on the application of the ML model 126 on the received at least one image 302A. The ML model 126 may be a model that is trained with a training set to be able to detect and identify different objects present in an image. By way of example, the ML model 126 may be a trained Convolutional Neural Network (CNN), or a variant thereof. The ML model 126 may output a likelihood for a detected object in a given image. Such likelihood may be indicative of a specific class label (or an object class) for the detected object, for example, a speaker, a display, or other object present in the listening environment 110. Additionally, in some embodiments, the circuitry 202 may be configured to determine a type of listening environment based on the identification of the plurality of objects in the listening environment 110. Examples of the type of listening environment may include, but is not limited to, a living room, a bedroom, a concert hall, an auditorium, a stadium, or a recording studio. By way of example, in instances where the identified plurality of objects in the listening environment 110 includes a display device 112A, one or more windows, a sofa, and a group of speakers placed around the sofa and the display device 112A, the type of listening environment may be determined as a living room. The circuitry 202 may be further configured to control one or audio parameters (such as, but not limited to, volume, gain, frequency response, equalization parameters, filter coefficients) of each of the plurality of audio devices 116A-116N based on the determined type of the listening environment. For example, in an auditorium or concert hall type of the listening environment 110, the volume could be higher, however the volume may be lower for a bedroom type of the listening environment 110.

At 306, a contour information determination operation may be executed. In the contour information determination operation, the circuitry 202 may be configured to determine contour information of each of the identified plurality of objects detected in the received at least one image 302A. The circuitry 202 may be configured to determine a plurality of contours 308A-308C (as the contour information) for each of the plurality of objects. For example, as shown in FIG. 3, the circuitry 202 may determine the plurality of contours 308A-308C for the display device 112A and the plurality of audio devices 116A-116N. The plurality of contours 308A-308C may be determined for the plurality of objects detected in the received at least one image 302A. In general, the contour of an object in an image may represent a boundary or an outline of the object and may be used to localize the object in the image, as shown, for example, in an image 308 shown in FIG. 3. As an example, there is shown a first contour 308A, a second contour 308B, and a third contour 308C for a first audio device, a display device, and a second audio device, respectively detected as the plurality of objects in the image 302A. In an embodiment, the determined contour information may represent one or more bounding boxes for one or more objects detected in the captured image 302A or in the image 308 including the bounding boxes. In an embodiment, the circuitry 202 may be configured to apply the ML model 126 on the captured image 302A to determine the plurality of contours 308A-308C or the bounding boxes (as shown in the image 308). In an embodiment, the contour information may indicate dimensions (i.e. width or height) of the bounding boxes of the plurality of objects detected in the captured image 302A. In other words, the contour information may indicate the dimensions of the plurality of objects detected in the captured image 302A.

The circuitry 202 may be further configured to output a layout map or a room map for the listening environment 110 based on the determined plurality of contours 308A-308C. The layout map may be indicative of relative placement of the plurality of objects (such as the display device 112A, the seating structure 1128, and the plurality of audio devices 116A-116N) in the listening environment 110. It may be assumed that once the at least one image 302A is captured, the relative placement of the plurality of objects in the listening environment 110 remains the same. In some embodiments, the circuitry 202 may generate the layout map or the room map for the listening environment 110 based on the application of the ML model 126 on the first image captured from the first viewpoint 128 and the second image captured from the second viewpoint 130.

In certain embodiments, the circuitry 202 may be further configured to output the layout map on the user device 120 or the display device 112A and receive a user input on the layout map. Such a user input may be a touch input, a gaze-based input, a gesture input, or any other input known in the art and may indicate the user location in the listening environment 110. In such instances, the circuitry 202 may be configured to determine the listening position in the listening environment 110 based on the received user input. As an example, the user 122 may touch the sofa on the output layout map to pinpoint the user location as the listening position.

Initially, the circuitry 202 may be configured to determine the listening position in the listening environment 110. The listening position may be defined by a location at which the image-capture device 104 captures the at least one image 302A. By way of example, the listening position may be determined based on Global Navigation Satellite System (GNSS) information of a GNSS receiver a Global Position System (GPS) in the image-capture device 104. Such GNSS information may be part of metadata associated with the at least one image 302A. Alternatively, the listening position may be determined to be an origin (i.e. 0,0, and 0) for the listening environment 110 and may be either preset for the listening environment 110 or user-defined. In such a case, the location of all objects in the listening environment 110 may be estimated relative to the listening environment 110. For example, the user 122 may be instructed to setup the image-capture device 104 at the extreme left hand side corner of the listening environment 110 and close to a wall facing opposite to that for the display device 112A.

At 310, real-dimension information retrieval operation may be executed. In an embodiment, the circuitry 202 may be configured to retrieve the real-dimension information of each of the identified plurality of objects. In an embodiment, the memory 204 may store the real-dimension information of each of the identified plurality of objects. In an embodiment, the plurality of objects (such as the display device 112A and the plurality of audio devices 116A-116N) may be communicatively coupled to the electronic apparatus 102, via the communication network 108 (i.e. using technologies such as, but not limited to, a Bluetooth™). The electronic apparatus 102 may retrieve model information from the display device 112A and the plurality of audio devices 116A-116N or from the audio reproduction system 114. The model information may indicate the real-dimension information of each of the identified plurality of objects (such as the display device 112A or the plurality of audio devices 116A-116N). The real-dimension information may indicate a real height, a real width, or a real length of the display device 112A and the plurality of audio devices 116A-116N.

At 312, a first distance determination operation may be executed. In an embodiment, the circuitry 202 may be configured to determine the first distance information (i.e. first distance) between the listening position in the listening environment 110 and each of the identified plurality of objects based on the determined contour information and the retrieved real-dimension information of each of the identified plurality of objects. For the first distance information, the circuitry 202 may be configured to compute an in-image location of each of the plurality of objects in the listening environment 110. By way of example, an in-image location of a point in an image with a 2D coordinate value (d) may be measured with respect to an image place (P) of the image-capture device 104. In order to compute the in-image location for each of the plurality of objects, the circuitry 202 may be configured to compute a pixel information from the at least one image 302A.

By way of example, a living room may include a 5:1 surround sound setup, which includes a group of 5 speakers (e.g., a left speaker (LS), a right speaker (RS), a center speaker (CS), a left surround speaker (LSR), and a right surround speaker (RSS) and 1 sub-woofer (SW). Further, the display device 112A may be between the left speaker (LS) and the right speaker (RS) of the 5:1 surround sound setup, more specifically, to be at the mid-point of a line segment which has the pair of left and right audio devices at its two endpoints. The living room may include the listening position at a corner of the living room. The circuitry 202 may determine the first distance information between each speaker of the 5:1 surround sound setup and the listening position, and the first distance information between the display device 112A and the listening position may be calculated. The details of the determination of the first distance information are provided, for example, in FIG. 5A.

At 314, an audio signal reception operation may be executed. In an embodiment, the circuitry 202 may be configured to control the audio capturing device 124, at the listening position, to receive the audio signal from each of the plurality of audio devices 116A-116N. At a certain time instant, an audio file may be provided to a plurality of audio channels of the plurality of audio devices 116A-116N for audio reproduction. The audio signal(s) corresponding to the audio reproduction from the plurality of audio devices 116A-116N may be received (or recorded) via the audio capturing device 124, for example, a mono-microphone associated the user device 120. The audio capturing device 124 of the user device 120 may record the audio signal reproduced from each of or at least one of the plurality of audio devices 116A-116N up to a defined time period (say certain seconds). The user device 120 may transmit the recorded audio signal(s) from the plurality of audio devices 116A-116N to the electronic apparatus 102, via the communication network 108.

At 316, a second distance determination operation may be executed. In an embodiment, the circuitry 202 may be configured to determine the second distance information (i.e. second distance) between each of the plurality of audio devices 116A-116N and the listening position in the listening environment 110 based on the received audio signal from each of the plurality of audio devices 116A-116N. As an example, the second distance may be determined based on Time-of-Arrival (TOA) measurements of the audio signal for each of the plurality of audio devices 116A-116N. A TOA measurement may include the time taken by the audio signal to reach the audio capturing device 124 from an audio device as soon as the audio device is activated to play a sound to generate the audio signal. Based on the speed of sound (i.e. 330 m/sec) and the time taken, the second distance measurement between the audio capturing device 124 (i.e. assumed listening position) and the audio device (such as each of the plurality of audio devices 116A-116N) may be performed.

In another embodiment, based on the first distance information (i.e. determined based on the image 302A) for each audio device, the circuitry 202 may determine time information that may indicate a time at which the audio signal may reach the audio capturing device 124 from the corresponding audio device. For example, for the first audio device of the plurality of audio devices 116A-116N, based on the ratio of the first distance information (between the listening position and the first audio device) and the speed of sound (i.e. 330 m/sec), the circuitry 202 may determine the time at which the audio played by the first audio device may reach the audio capturing device 124 for recording. The circuitry 202 may further determine a number of samples of the audio (i.e. reproduced by the first audio device) based on the determined time information and known sampling frequency of the reproduced audio. For example, the number of samples may be mathematical product of the determined time information and the sampling frequency (in Hz). The circuitry 202 may further determine a start point of recording based on an end time of recording for the first audio device and determined number of samples. For examples, the circuitry 202 may back-track the number of samples from the end time of recording in a recording time-axis, to determine the start point of recording for the first audio device.

In accordance with an embodiment, the circuitry 202 may further determine a time delay between a time instant at which the audio capturing device 124 may be activated for recording and the determined start point of recording. The time instant at which the audio capturing device 124 may be activated for recording may be similar to a time instant when the first audio device may be activated to playback the audio file. The time delay may further correspond to an actual time taken by the audio reproduced by the first audio device to reach the audio capturing device 124. Further, the circuitry 202 may determine the second distance information between the listening position and the first audio device, based on mathematical product of the determined time delay and the speed of sound (i.e. 330 m/sec). Similarly, the circuitry 202 may determine the second distance information between each of the plurality of audio devices 116A-116N and the listening position in the listening environment 110 based on the received audio signal from each of the plurality of audio devices 116A-116N.

At 318, an anomaly detection operation may be executed. In the anomaly detection operation, the circuitry 202 may be configured to determine an anomaly in the connection of one or more audio devices of the plurality of audio devices 116A-116N in the listening environment 110. Operations for the determination of the anomaly are described herein. At first, the circuitry 202 may be configured to receive the user location (such as, the listening position) in the listening environment 110. The user location may correspond to GPS co-ordinates of the user device 120 associated with the user 122. Alternatively, the user location may be based on a user input (as described, for example, at 304) from the user 122. Alternatively, it may be assumed that the user 122 is seated on the seating structure 1128 and therefore, the user location may be identified to be same as a location of the seating structure 1128.

For each of the plurality of audio devices 116A-116N, the circuitry 202 may be configured to compare the determined first distance information and the determined second distance information. The determination of the anomaly in the connection of one or more audio devices may be based on the comparison of the second distance information with the determined first distance information. As an example, a speaker (S) may be placed to the left of the display device 112A and its connection may be incorrectly made to the right speaker channel (i.e. reserved for a right speaker). As the audio signal provided to the right speaker channel may be played by the speaker (S), the second distance information determined based on the recorded audio signal may not match with the first distance information between the user location (i.e. listening position) and a location of a left speaker identified in the image (such as the image 302A). This may be helpful to determine whether the speaker (S) is correctly connected to the left speaker channel as per its location in the listening environment 110 based on the comparison of the first distance information (i.e. determined based on the captured image) and the second distance information (i.e. determined based on the recorded audio signal). The determination of the anomaly is further described in detail, for example, in FIG. 7.

By way of example, the anomaly in connection may correspond to an incorrect connection or a missing connection of one or more audio devices with the AVR 118. The missing connection may correspond to a connection which has not been established between the AVR 118 and an audio device of the audio reproduction system 114. As an example, an incorrect connection may be based on a determination that a speaker kept on the right side of the display device 112A is connected to a left output port of the AVR 118. In instances where a speaker is not connected to any audio port on the AVR 118, the connection of the speaker may be marked as a missing connection.

At 320, a reconfiguration operation may be executed. In the reconfiguration operation, the circuitry 202 may be configured to generate connection information associated with the plurality of audio devices 116A-116N based on the determined anomaly in the connection of one or more audio devices. The generated connection information may be shared with the user device 120, via the communication network 108. The connection information may include, for example, a connection status of each audio device marked in the identified layout, a type of anomaly associated with each audio device, and/or a current quality-measure of the audio reproduction system 114. The connection information may also include, for example, instructions for the user 122 to establish a connection between an audio device and the AVR 118 and rectify the incorrect connection or the missing connection. Additionally, or alternatively, in some embodiments, the circuitry 202 may be configured to transmit the connection information to the AVR 118. The AVR 118 may receive the connection information and attempt to establish the missing connection or to correct the incorrect connection based on the received connection information.

The circuitry 202 may be configured to generate configuration information for calibration of the plurality of audio devices 116A-116N. The configuration information may be generated based the determined anomaly in the connection, a layout of the plurality of audio devices 116A-116N in the listening environment 110, the listening position, and the generated connection information for the plurality of audio devices 116A-116N. The circuitry 202 may further communicate the generated configuration information with the AVR 118 of the audio reproduction system 114. The configuration information may include a plurality of fine-tuning parameters for at least one audio device of the plurality of audio devices 116A-116N. The AVR 118 may receive the configuration information for the plurality of audio devices 116A-116N and may calibrate each of the plurality of audio devices 116A-116N based on the plurality of fine-tuning parameters.

In some embodiments, there may be multiple listening environments such as the listening environment 110 and the different listening environment 210. The different listening environment 210 may also have the same layout or a different layout of audio devices as the listening environment 110. Additionally, in certain instances, the number and position of objects in the different listening environment 210 may be same as that for the listening environment 110. At a time-instant, the user may change his/her position from the listening environment 110 to the different listening environment 210. The different listening environment 210 may include the different audio reproduction system 212. In order to ensure that the user gets the same audio listening experience in the different listening environment 210, the circuitry 202 may detect a change in the user location from the listening environment 110 to the different listening environment 210 and may share the configuration information generated for the audio reproduction system 114 with the different audio reproduction system 212. In some embodiments, the AVR 118 may be configured to share the configuration information generated for the audio reproduction system 114 with the different AVR 214 in the different listening environment 210. The circuitry 202 may be further configured to configure the different audio reproduction system 212 in the different listening environment 210 based on the shared configuration information. Alternatively, in some embodiments, the different AVR 214 may configure the different audio reproduction system 212 in the different listening environment 210 based on the shared configuration information.

It should be noted that operations of data acquisition at 302, object detection at 304, contour information determination at 306, real-dimension information retrieval at 310, first distance determination at 312, audio signal reception 314, and the second distance determination may be a one-time operation that may occur during an initial setup of the audio reproduction system 114. These operations may have to be repeated when the location of at least one audio device changes in listening environment 110. Whereas, for example, the anomaly determination at 318 and the reconfiguration at 320 may be performed every time the user 122 enters the listening environment 110.

Figure 4:
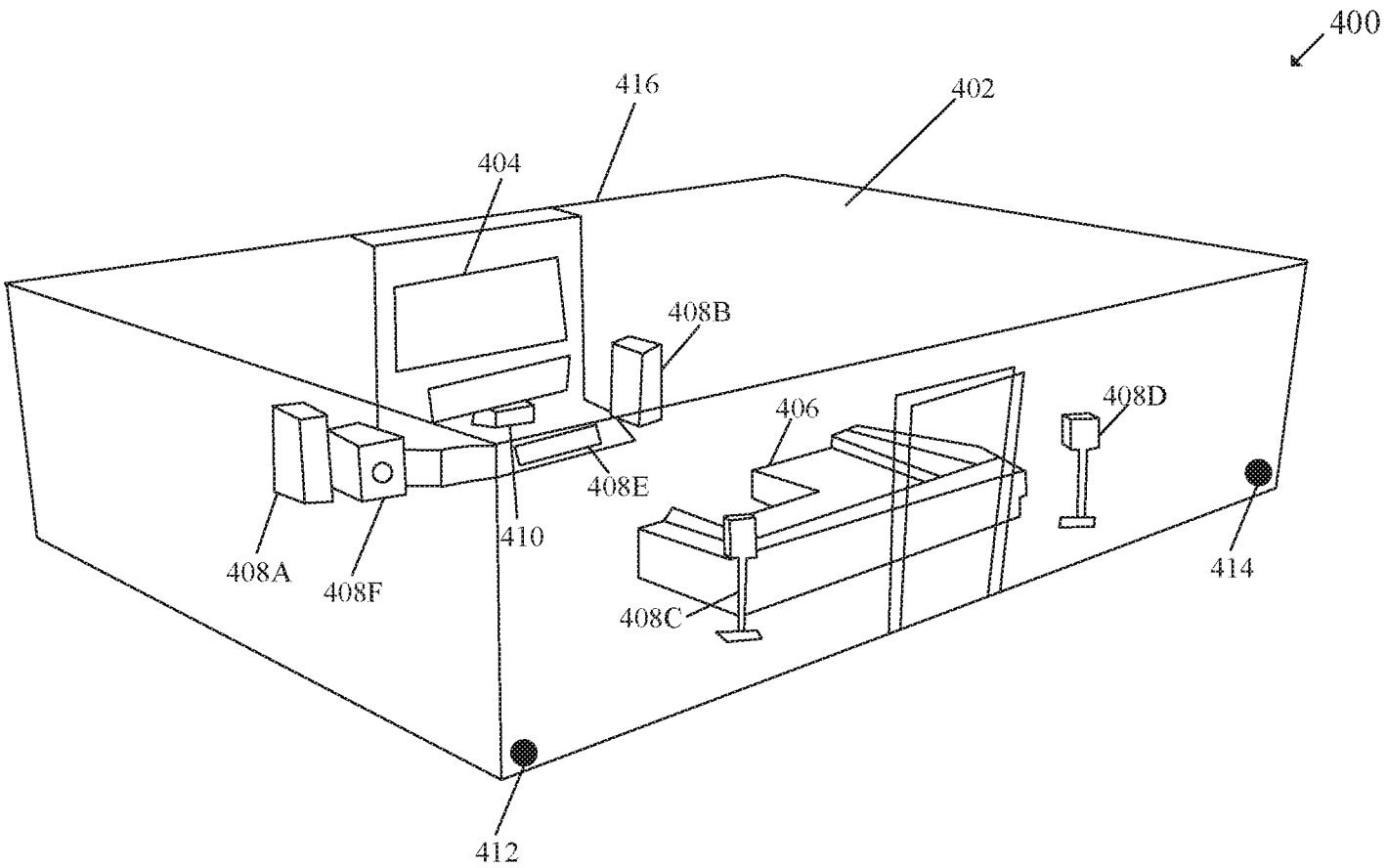
FIG. 4 is a diagram that illustrates a view of an example layout of objects in an example listening environment, in accordance with an embodiment of the disclosure.

FIG. 4 is a diagram that illustrates a view of an example layout of objects in an example listening environment, in accordance with an embodiment of the disclosure. FIG. 4 is explained in conjunction with elements from FIG. 1, FIG. 2, and FIG. 3. With reference to FIG. 4, there is shown a view 400 of an example layout of objects in an example listening environment 402 (hereinafter, "listening environment 402"). The listening environment 402 may include a plurality of objects, such as a display device 404, a seating structure 406, and an audio reproduction system. The audio reproduction system may be a 5:1 surround system, which includes a first audio device 408A, a second audio device 408B, a third audio device 408C, a fourth audio device 408D, a fifth audio device 408E, a subwoofer 408F and an AVR 410. In FIG. 4, there is further shown a first viewpoint 412 of the listening environment 402.

The display device 404 may be placed on a wall 416 at the center, for example. The seating structure 406 may be at the center of the listening environment 402. The placement of the first audio device 408A, the second audio device 408B, the third audio device 408C, the fourth audio device 408D, the fifth audio device 408E may be with respect to the display device 404 and the seating structure 406. The first audio device 408A may be placed to the left of the display device 404 and may be referred to as a left speaker. Similarly, the second audio device 408B may be placed to the right of the display device 404 and may be referred to as a right speaker. In some embodiments, the first audio device 408A and the second audio device 408B may be spaced apart by equal distance from the display device 404. Additionally, it may be assumed that the first audio device 408A, the second audio device 4088, and the display device 404 lie on a common horizontal line. Also, in some instances, it may be further assumed that the display device 404 is placed at the midpoint of the common horizontal line, with first audio device 408A and the second audio device 408B at two endpoints of the common horizontal line.

The third audio device 408C may be placed behind the seating structure 406 and to left of the seating structure 406 and may be referred to as a surround left speaker. The fourth audio device 408D may be placed behind the seating structure 406 and to the right of the seating structure 406 and may be referred to as a surround right speaker. The fifth audio device 408E may be placed directly above or below the display device 404 and may be referred to as a center speaker. The subwoofer 408F and the AVR 410 may be placed anywhere in the listening environment 402, according to convenience of the user 122.

The circuitry 202 may be further configured to determine first location information of each of the plurality of audio devices 408A-408F in the listening environment 402 based on the determined first distance information (i.e. first distance) between the listening position (such as a first viewpoint 412 from the image 302A is captured) and each of the plurality of audio devices 408A-408F. By way of example, the first location information may be determined based on a set of computations which may be performed based on certain geometry models or mathematical relationships established among certain objects and/or reference locations in the listening environment 110. The details of the estimation of the first location information are described, for example, in FIG. 6. The determined first location information may include, for example, a 2D coordinate (X-Y value) of each of the plurality of audio devices 408A-408F, with respect to reference location(s) in the listening environment 110.

In an embodiment, the circuitry 202 may be configured to compute an in-image location of each of the plurality of audio devices 408A-408F in the listening environment 402. By way of example, an in-image location of a point in an image with a 2D coordinate value (d) may be measured with respect to an image place (P) of the image-capturing device 104. In order to compute the in-image location for each of the plurality of audio devices 408A-408F, the circuitry 202 may be configured to compute pixel information from the received image 302A, as described, for example, in FIG. 5A.

In an embodiment, the plurality of audio devices 408A-408F may include an audio device (such as, the third audio device 408C) positioned at a defined height from the listening position in the listening environment 402. The defined height from the listening position may refer to a particular height above a height of the listening position in the listening environment 402. For example, the height of the listening position in the listening environment 402 may correspond to a height at which the image-capture device 104 may be positioned to capture images. The circuitry 202 may be further configured to determine the first distance information between the listening position and the third audio device 408C. The determination of the first distance information between the listening position and the audio device (such as the third audio device 408C), is described for example, in FIG. 5A.

The circuitry 202 may be further configured to determine the first distance information between the listening position and the second audio device 408B (or the first audio device 408A) positioned at a same height of the listening position in the listening environment 402. The determination of the first distance information between the listening position and the second audio device 408B, is described, for example, in FIG. 5A.

The circuitry 202 may be further configured to determine elevation angle information (i.e. elevation angle) between the listening position and the third audio device 408C based on the determined first distance information related to the third audio device 408C and the second audio device 408B. The elevation angle information may correspond to an angle between a horizontal plane of the listening environment 402, and a position of the plurality of audio devices 408A-408F which may be positioned above to a head center of the user 122 (i.e. listener positioned at the listening position). The horizontal plane (not shown) may be, for example, an axis orthogonal to a line (not shown) that may join the first viewpoint 128 and the second viewpoint 130. The elevation angle information may indicate a specific direction in which each corresponding audio device of the plurality of audio devices 408A-408F is located in the listening environment 402 with respect to the horizontal plane. The determination of the elevation angle information is further described, for example, in FIG. 8.

The circuitry 202 may be further configured to determine second location information of the display device 404 in the listening environment 402 based on the determined first distance information between the listening position (such as the first viewpoint 412) and the display device 404. The second location information may be determined based on the determined first location information of the plurality of audio devices 408A-408F. For example, it may be assumed that the display device 404 is placed exactly at the center and between two audio devices which are on same horizontal axis. In such instances, the second location information (e.g., a 2D coordinate value) may be determined as a mean of locations of the two audio devices.

In an embodiment, the circuitry 202 may be configured to determine the second location information of the display device 404 based on the pixel information for the display device 404 in the received image 302A of the listening environment 402. The pixel information may be further used to determine actual co-ordinates of the display device 404 in the listening environment 402, with respect to a first reference location. The first reference location may be a location at which the image-capture device 104 captures the image 302A from the first viewpoint 412. The first reference location may be defined by a location co-ordinate at which the image-capture device 104 captures the image 302A. In an embodiment, the first reference location may the listening position at which the image-capture device 104 captures the image 302A, as described, for example, at 306 in FIG. 3. In some embodiments, the second location information (i.e. location) of the display device 404 may be approximated to be somewhere between a pair of left and right audio devices of the audio reproduction system 114 (shown in FIG. 1). For example, the display device 404 may be between the left speaker (LS) and the right speaker (RS) of the 5:1 surround sound setup, more specifically, to be at the mid-point of a line segment which has the pair of left and right audio devices at its two endpoints. In such a case, the second location information may be the location of the midpoint which may be, for example, an average of the locations of the pair of left and right audio devices.

The circuitry 202 may be further configured to identify a layout of the plurality of audio devices 408A-408F in the listening environment 402 based on the determined first location information and the determined second location information. Such a layout may include, for example, a mapping between each of the plurality of audio devices 408A-408F and a respective positional-specific identifier for the corresponding audio device. As an example, if the layout is identified to be a 5:1 surround sound setup, the mapping may be given by a mapping table (Table 1), as follows:

TABLE 1

Layout as a mapping between audio devices and positional identifier

| Audio Device | Positional Identifier |
|---|---|
| First audio device | Left Speaker |
| Second audio device | Right Speaker |
| Third audio device | Surround Left Speaker |
| Fourth audio device | Surround Right Speaker |
| Fifth audio device | Center Speaker |
| Sixth audio device | Subwoofer |

By way of example, in order to identify the layout of the plurality of audio devices 408A-408F, locations of the display device 404 and the seating structure 406 may be taken as a reference to assign the position-specific identifier of a defined layout to each of the plurality of audio devices 408A-408F. For example, two audio devices placed symmetrically to the left and the right of the display device 404 may be identified as left and right speakers. Another pair of audio devices placed symmetrically to the left and right of the seating structure 406 may be identified as left and right surround sound speakers. Similarly, another audio device placed right in front of the display device 404 may be identified as a center speaker. In case of identification of the left and right speakers, the left and right surround sound speakers, and the center speaker, the layout may be identified as a 5:1 surround sound layout.

Figure 5A:
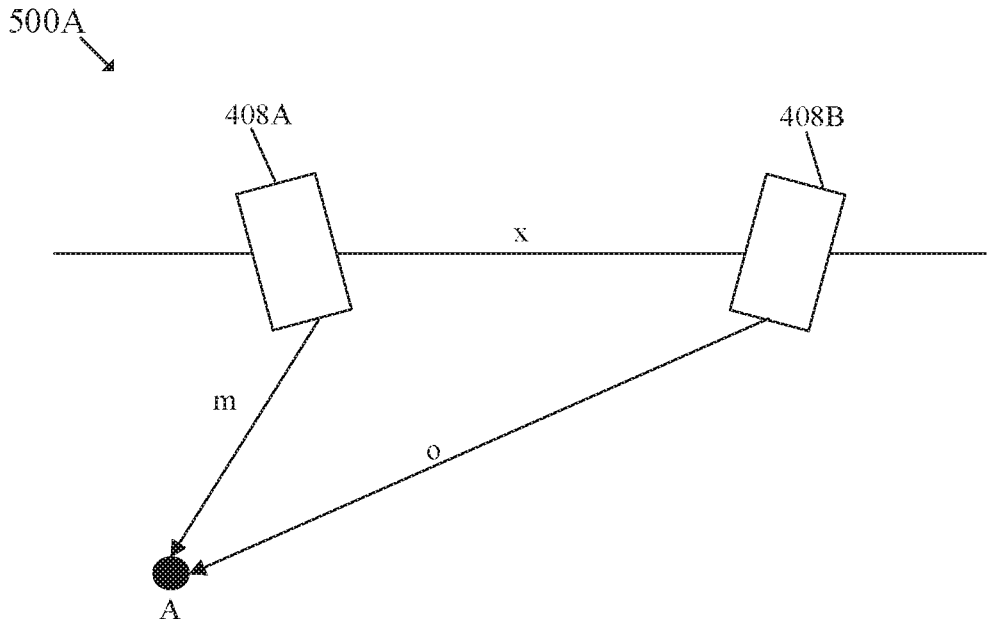
FIG. 5A is a diagram that illustrates exemplary calculations for a first distance between a listening position and an object, in accordance with an embodiment of the disclosure.

FIG. 5A is a diagram that illustrates exemplary calculations for a first distance between a listening position and an object, in accordance with an embodiment of the disclosure. FIG. 5A is explained in conjunction with elements from FIGS. 1, 2, 3, and 4. With reference to FIG. 5A, there is shown a diagram 500A. For the sake of brevity, in FIG. 5A, the distance calculation is limited for two audio devices (i.e. the first audio device 408A (the left speaker) and the second audio device 408B (the right speaker). Therefore, the diagram 500A may be construed for calculations of distance values (i.e. first distance information) related to the first audio device 408A and the second audio device 408B. The user 122 (for example with the user device 120 shown in FIG. 1) may be present at a listening position "A". A distance (for example an absolute distance) between the listening position "A" and the first audio device 408A may be denoted by "m", a distance (for example an absolute distance) between the listening position "A" and the second audio device 408B may be denoted by "o", and a distance between the first audio device 408A and the second audio device 408B may be denoted by "x", as shown in FIG. 5A.

In accordance with an embodiment, the circuitry 202 may be configured to retrieve the real-dimension information of the first audio device 408A and the second audio device 408B as described, for example, at 310 in FIG. 3. Further, the circuitry 202 may be configured to determine at least one of height information (i.e. height) or width information (i.e. width) of the first audio device 408A and the second audio device 408B based on the received image 302A (or the image 308) of the listening environment 110. The circuitry 202 may be configured to extract the height information or the width information from the contour information determined for the identified plurality of objects (such as the first audio device 408A and the second audio device 408B). The contour information (i.e. bounding boxes) is described, for example, at 306 in FIG. 3. In another embodiment, the contour information may also include length information (i.e. real length) of each of the identified plurality of objects and the circuitry 202 may extract the length information from the contour information determined for the identified plurality of objects (such as the first audio device 408A and the second audio device 408B). The circuitry 202 may be further configured to determine the first distance information (i.e. the first distance denoted as "m" in FIG. 5A) between the listening position "A" and the first audio device 408A based on the determined height information (or the width information) of the first audio device 408A and the retrieved real-dimension information of the first audio device 408A. Similarly, the circuitry 202 may determine the first distance information (i.e. the first distance denoted as "o" in FIG. 5A) between the listening position "A" and the second audio device 408B based on the determined height information (or the width information) of the second audio device 408A and the retrieved real-dimension information of the second audio device 408B. In an embodiment, the circuitry 202 may be further configured to determine the first distance information based on information associated with the image-capturing device 104. The information may include, but is not limited to, a focal length, and a height or a width of a sensor of the image-capturing device 104. In an embodiment, the circuitry 202 may be further configured to determine the first distance information based on a resolution of the received image 302A. As an example, the first distance information (i.e. first distance) may be calculated using equation (1), as follows:

$$\text{first distance} = \frac{\text{focal length} * \text{real height} * \text{image height}}{\text{object height} * \text{sensor height}} \quad (1)$$

where, the focal length may denote a focal length of the image-capture device 104 during the capture of the image 302A, the real height may denote a real height of the audio device, the image height may denote a resolution of the received image 302A, the object height may denote the height information (in pixels) of the audio device in the received image 302A, and the sensor height may denote a height of an image sensor of the image-capture device 104 which captured the image 302A.

It may be noted that equation (1) explained in terms of height is merely an example. The equation (1) may be used to calculate the first distance information based on width (such as real-width of the audio device and the width information (in pixels)) or based on length (such as real-length of the audio device and the length information (in pixels)) of the audio device.

As an example, the real height of each of the plurality of audio devices 408A-408F may be known from a model specification (i.e. model information) associated with each of the plurality of audio devices 408A-408F. Further, the focal length of the image-capture device 104 and the sensor height may be determined based on specification of the image-capture device 104. The image height (i.e. resolution) may be determined based on the specification of the image-capturing device 104 or based on current image capture setting of the image-capturing device 104. Therefore, based on the equation (1), the circuitry 202 may determine the first distance (i.e. "m" and "o" in FIG. 5A) between the listening position "A" and each of the plurality of audio devices 408A-408F in the listening environment 402. In another embodiment, the circuitry 202 may also determine the first distance (i.e. absolute between the listening position "A" and the display device 404 based on various factors (i.e. real dimension of the display device 404, height/width information (in pixels) of the display device 404 in the image 302A, image height, focal length, and sensor dimensions). Thus, the disclosed electronic apparatus 102 may determine the first distance, as the absolute distance, between the listening position "A" and each of the identified plurality of objects in the listening environment 402 with the use of a single camera (i.e. image-capturing device 104) and single captured image (either the first image as image 302A or the second image) rather than using a stereo-camera or using a stereo image.

In accordance with an embodiment, the circuitry 202 may be further configured to determine a pixel per metrics for the audio device of the plurality of audio devices 408A-408F based on the height information of the audio device in the image 302A and based on a real-height, indicated in the retrieved real-dimension information, of the audio device. Examples of the pixel per metrics may include, but is not limited to, a pixel per inch or a pixel per centimeter. As an example, the pixel per metrics for the audio device may be calculated using equation (2), as follows:

$$\text{pixel per metrics} = \frac{\text{real height}}{\text{object height}} \quad (2)$$

In reference to FIG. 5A, the circuitry 202 may be further configured to determine a pixel distance between the first audio device 408A and the second audio device 408B of the plurality of audio devices 408A-408F in the image 302A. The pixel distance may be determined based on the received image 302A of the listening environment. The circuitry 202 may be further configured to determine third distance information (such as a distance denoted by "x" in FIG. 5A) between the first audio device 408A and the second audio device 408B based on the determined pixel per metrics and the determined pixel distance between the first audio device 408A and the second audio device 408B. As an example, the value for "x" may be calculated using equation (3), as follows:

$$\text{third distance ("}x\text{")} = \text{pixel distance} * \text{pixel per metrics} \quad (3)$$

The circuitry 202 may be configured to determine the third distance information between each audio device and other audio devices of the plurality of audio devices 408A-408F based on the determined pixel per metrics and the determined pixel distance between different audio devices as indicated by the equation (3). In some embodiments, the circuitry 202 may determine the third distance information between each audio device and the display device 404 in the listening environment 402 based on the equation (3).

Figure 5B:
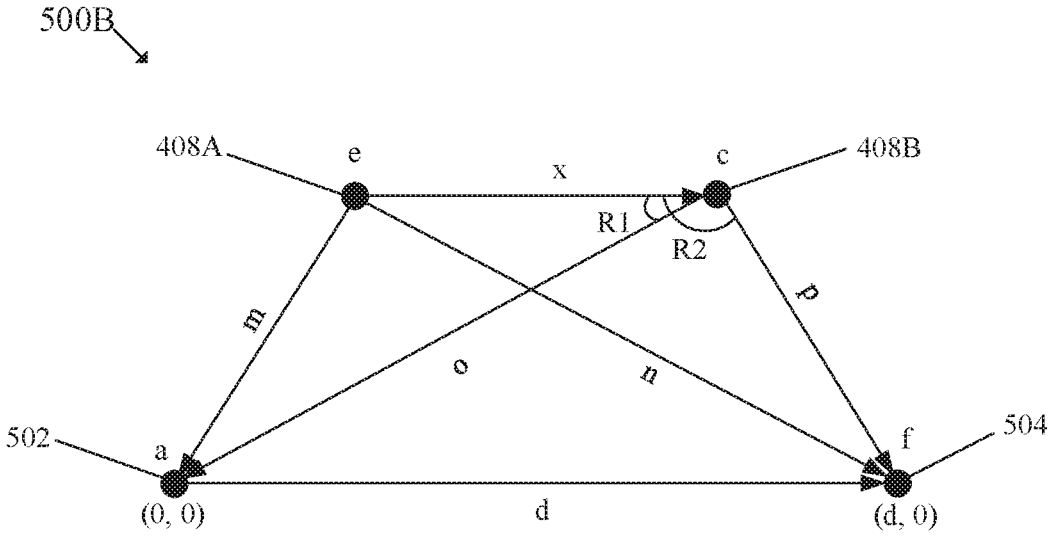
FIG. 5B is a diagram that illustrates exemplary distances calculation between user locations, in accordance with an embodiment of the disclosure.

FIG. 5B is a diagram that illustrates exemplary distances calculations between user locations, in accordance with an embodiment of the disclosure. FIG. 5B is explained in conjunction with elements from FIGS. 1, 2, 3, 4, and 5A. With reference to FIG. 5B, there is shown a diagram 500B. For the sake of brevity, in FIG. 5B, the distance calculation is limited for two audio devices (i.e. the first audio device 408A (the left speaker) and the second audio device 408B (the right speaker). Therefore, the diagram 500B may be construed for calculations of distance between two user locations, in light of the first audio device 408A and the second audio device 408B.

In FIG. 5B, there is shown a first reference location 502 and a second reference location 504 which may refer to the first viewpoint 412 and a second viewpoint 414 (shown in FIG. 4), respectively. The image-capture device 104 may capture a first image (such as the image 302A) of the listening environment 402 from the first reference location 502 (i.e. first viewpoint 412). Similarly, the image-capturing device 104 may capture a second image (i.e. another image) of the listening environment 402 from the second reference location 504 (i.e. second viewpoint 414). The first reference location 502 and the second reference location 504 may be separated by a distance "d", referred to as a baseline. The first reference location 502 at which the image-capturing device 104 captures the first image may be selected as (0, 0)

and the second reference location 504 at which the image-capturing device 104 captures the second image may be determined as (d, 0), where the distance between the first reference location 502 and the second reference location 504 may be given by "d". For example, the first reference location 502 and the second reference location 504 represented as (0, 0) and (d, 0) may be determined in the listening environment 402 without the GPS data (i.e. described further, in FIG. 6).

The distance between the first reference location 502 and the first audio device 408A may be denoted by "m". The distance between the first reference location 502 and the second audio device 408B may be denoted by "o". The distances ("m" and "0") between the listening position A" (i.e. first reference location 502) and the first audio device 408A and the second audio device 408B are also described, for example, in FIG. 5A. Similarly, the circuitry 202 may be configured to determine the first distance information (i.e. absolute distance) between the listening position (i.e. second reference location 504) and the first audio device 408A and the second audio device 408B, as "n" and "p", respectively as shown in FIG. 5B. Further, in FIG. 5B, the distance (i.e. third distance) between the first audio device 408A and the second audio device 408B is referred as "x". The determination of the distance between two audio devices is described, for example, in FIG. 5A.

As shown in FIG. 5B, the angle between "x" and "o" may be denoted by "R1" and the angle between the "x" and "p" may be denoted by "R2". The circuitry 202 may be further configured to determine the angles R1 and R2, and the distance ("d") between the user locations (i.e. first reference location 502 and the second reference location, by using the equations (4), (5), (6), and (7) as follows:

$$R1 = \cos^{-1}\left(\frac{x^2 + o^2 - m^2}{2xo}\right) \tag{4}$$

$$R2 = \cos^{-1}\left(\frac{p^2 + x^2 - n^2}{2px}\right) \tag{5}$$

$$D = R2 - R1 \tag{6}$$

$$\text{Distance}(\text{“}d\text{”}) = sqrt(o^2 + p^2 - 2po)(\cos(D))) \tag{7}$$

Figure 6:
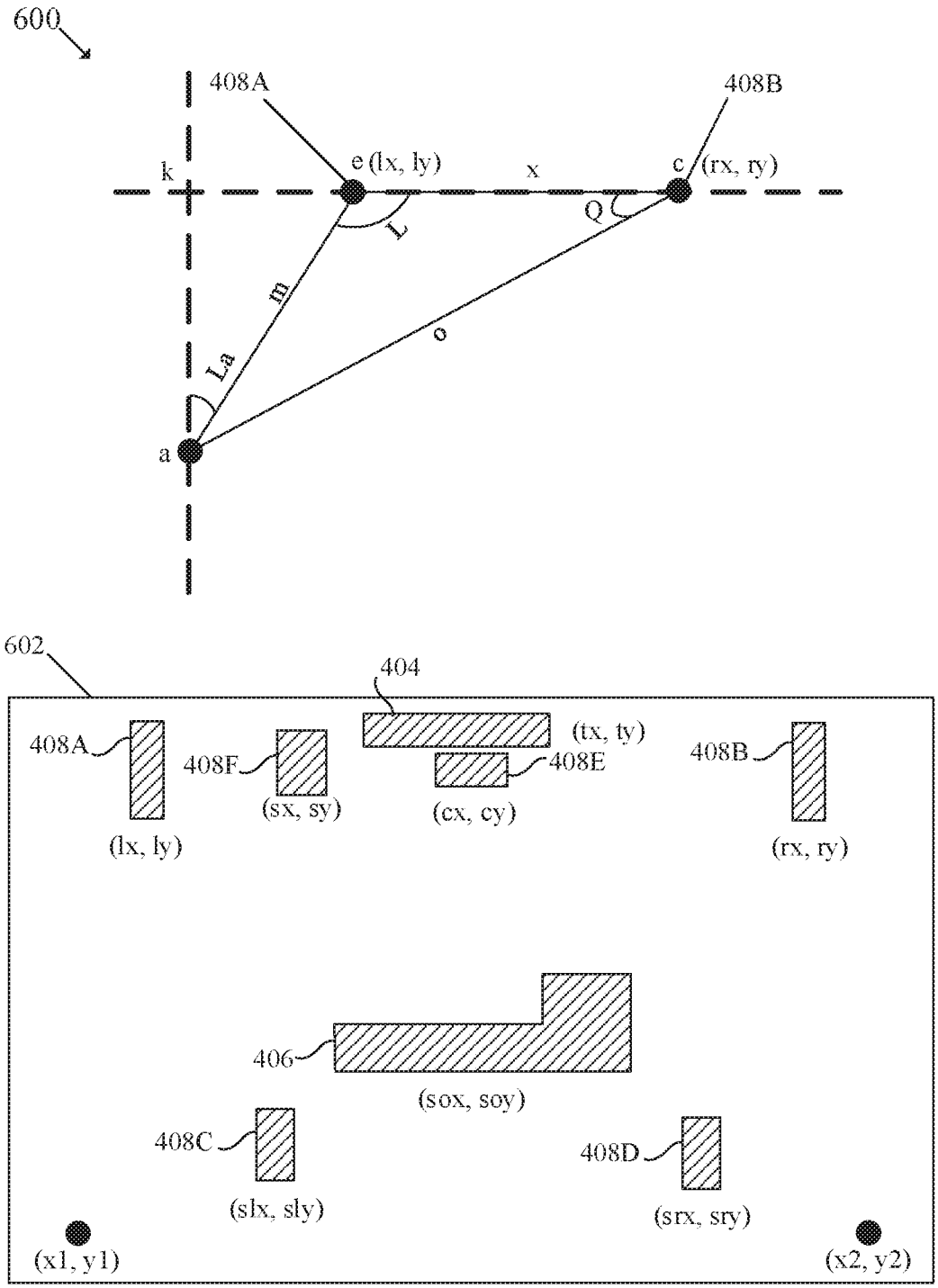
FIG. 6 is a diagram that illustrates exemplary localization of audio devices in an example layout of the audio devices, in accordance with an embodiment of the disclosure.

FIG. 6 is a diagram that illustrates exemplary localization of audio devices in an example layout of the audio devices, in accordance with an embodiment of the disclosure. FIG. 6 is explained in conjunction with elements from FIGS. 1, 2, 3, 4, 5A, and 5B. With reference to FIG. 6, there is shown an example diagram 600 for localization of the plurality of audio devices 408A-408F, as depicted in an example layout 602.

As shown in the example layout 602, the first audio device 408A, the second audio device 408B, the third audio device 408C, the fourth audio device 408D, and the fifth audio device 408E may be at (lx, ly), (rx, ry), (slx, sly), (rlx, rly), and (cx, cy) locations, respectively. As further shown in the example layout 602, the display device 404 and the seating structure 406 may be at (tx, ty) and (sox, soy) locations, respectively. The first reference location may be at (x1, y1) which may be a location at which the image-capture device 104 captures the image 302A from the first viewpoint 412 (shown in FIG. 4). Similarly, the second reference location may be at (x2, y2) which may be a location at which the image-capture device 104 captures the image 302A from the second viewpoint 414 (shown in FIG. 4) or the second viewpoint 130 (shown in FIG. 1).

The circuitry 202 may be configured to determine the first location information ((lx, ly), (rx, ry), (slx, sly), (srx, sry), (cx, cy), and (sx, sy)) of the plurality of audio devices 408A-408F. The first location information may refer to actual co-ordinates (i.e. 2D coordinate (x-y value)) of each audio device of the plurality of audio devices 408A-408F measured with respect to a reference location (such as the first reference location or the second reference location) of the listening environment 402. The determination of the first location information may be based on the first reference location (x1, y1) or the second reference location (x2, y2) shown in FIG. 6. The first reference location (x1, y1) or the second reference location (x2, y2) may be determined from GNSS or GPS data of the user device 120 when the user 122 captures images from the first reference location (x1, y1) and/or the second reference location (x2, y2).

Alternatively, in some embodiments, the first reference location (x1, y1) or the second reference location (x2, y2) may be determined without GNSS/GPS data. In such instances, the first reference location (x1, y1) may be considered as (0, 0) (and represented as "a") and the second reference location (x2, y2) may be considered as (d, 0), where "d" may represent a distance between the first reference location and the second reference location as described, for example in FIG. 5B. Further, the angle between "x" (i.e. distance between the first audio device 408A and the second audio device 408B) and "m" (i.e. distance between the first audio device 408A and the first reference location, i.e. listening position "A" as per FIG. 5A) may be denoted by "L". The angle between "o" (i.e. distance between the second audio device 408B and the first reference location, i.e. listening position "A" as per FIG. 5A), and "x" may be denoted by "0" and the angle between "a-k" and "m" may be denoted by "La", as shown, for example, in FIG. 6.

As an example, the circuitry 202 may be configured to determine the first location information (i.e. location (lx, ly)) of the first audio device 408A by using equations (8), (9), (10), and (11), as follows:

$$L = \cos^{-1}\left(\frac{x^2 + m^2 - o^2}{2mx}\right) \tag{8}$$

$$La = L - 90° \tag{9}$$

$$lx = m \times \cos(La) \tag{10}$$

$$ly = m \times \sin(La) \tag{11}$$

Similarly, coordinates of other audio devices may be estimated.

It may be noted that the determination of the first location information (i.e. coordinates (lx, ly) for the first audio device 408A is merely shown as an example. Similarly, the circuitry 202 may be configured to determine the first location information for each of the plurality of audio devices 408A-408F and other objects (such as the display device 404 and the seating structure 406) using the equations (8, 9, 10, and 11). The details of the determination of the first location information for other audio devices and objects are excluded from the disclosure, for the sake of brevity.

As another example, the first reference location and the second reference location may be determined with the help of the GPS data. In such a scenario, the co-ordinates of the first reference location may be (x1, y1) and the co-ordinates of the second reference location may be (x2, y2). In such case, the first location information (i.e. co-ordinates) for the first audio device 408 may be estimated using equations (12) and (13), as follows:

$$lx=x1+m\times\cos(La) \quad (12)$$

$$ly=y1+m\times\sin(La) \quad (13)$$

Similarly, co-ordinates of other audio devices and other objects (such as display device and seating structure) may be determined.

The circuitry 202 may store the calculated co-ordinate for each audio device in the memory 204 as the first location information in the form of, for example, a table. As an example, the first location information as Table 2 may be given as follows:

TABLE 2

First Location Information

| Audio Device | Co-Ordinates |
|---|---|
| First audio device | (lx, ly) |
| Second audio device | (rx, ry) |
| Third audio device | (slx, sly) |
| Fourth audio device | (srx, sry) |
| Fifth audio device | (cx, cy) |
| Sixth audio device | (sx, sy) |

Similarly, the circuitry 202 may be further configured to determine the second location information (tx, ty) of the display device 404 and third location information (sox, soy) of the seating structure 406 based on the determined first distance information (i.e. absolute distance) between the listening position "A" and the display device 404 and the seating structure 406, respectively. The co-ordinates of the seating structure 406 may be obtained from the GNSS/GPS data of the user device 120 based on an assumption that that the user 112 (along with the user device 120) is seated on the seating structure 406. In accordance with an embodiment, the circuitry 202 may be further configured to identify the layout of the plurality of audio devices 408A-408F in the listening environment 402 based on the determined first location information and the determined second location information, as described, for example, in FIG. 4.

FIG. 7 is a diagram that illustrates exemplary determination of anomaly in connection of audio devices in an example layout of the audio devices, in accordance with an embodiment of the disclosure. FIG. 7 is explained in conjunction with elements from FIGS. 1, 2, 3, 4, 5A, 5B, and 6. With reference to FIG. 7, there is shown an example diagram 700 for determination of an anomaly in connection of one or more audio devices in a layout 702 of the plurality of audio devices 408A-408F.

The circuitry 202 may be configured to identify the layout 702 of the plurality of audio devices 408A-408F. The layout 702 may depict the plurality of audio devices 408A-408F at their respective locations in the listening environment, with respect to the display device 404, and the seating structure 406. The display device 404 and/or the seating structure 406 may be selected as two references to determine a positional identifier (e.g., L, R, C, SL, SR, etc.) for each of the plurality of audio devices 408A-408F. Additionally, in certain instances, the user location may be also considered as a reference to determine the positional identifier for each of the plurality of audio devices 408A-408F. Examples of the positional identifier may include, but is not limited to, L (left speaker), R (right speaker), C (center speaker), SL (surround left speaker), and SR (surround right speaker).

By way of example, the "x" co-ordinate and "y" co-ordinate of each of the plurality of audio devices 408A-408F may be compared with the "x" co-ordinate and "y" co-ordinate of the display device 404. The positional identifier may be determined as "L" if "x" co-ordinate of an audio device is less than the "x" co-ordinate of the display device 404 and the "y" co-ordinate of the audio device is approximately equal to the "y" co-ordinate of the display device 404. Similarly, if "x" co-ordinate of an audio device is more than the "x" co-ordinate of the display device 404 and the "y" co-ordinate of the audio device is approximately equal to the "y" co-ordinate of the display device 404, the positional identifier may be determined as "R". The positional identifier may be determined as "C" if the "x" co-ordinate of an audio device is same as the value of "x" co-ordinate of the display device 404 and only the "y" co-ordinate of the audio device is different from the "y" co-ordinate of the display device 404.

The "x" co-ordinate of the seating structure 406 may be compared with "x" co-ordinate of each of the plurality of audio devices 408A-408F. The positional identifier may be determined as "SL" if the "x" co-ordinate of the seating structure 406 is greater than the "x" co-ordinate of an audio device. Similarly, if the "x" co-ordinate of the seating structure 406 is less than the "x" co-ordinate of an audio device, the positional identifier may be determined as "SR". Thus, the disclosed electronic apparatus 102 may have information about a positional identifier of each audio device in the listening environment along with their co-ordinates. The circuitry 202 may further store the information in the memory 204 as a table, for example, Table 3, as follows:

TABLE 3

Positional Identifier of Audio Devices

| Positional Identifier | Co-ordinates |
|---|---|
| L | (lx, ly) |
| R | (rx, ry) |
| C | (cx, cy) |
| SL | (slx, sly) |
| SR | (srx, sry) |
| SW | (sx, sy) |

In certain scenarios, the user 122 (not shown in FIG. 7) may be seated on the seating structure 406. In such scenarios, the co-ordinates of the user location may be assumed to be same as the co-ordinates of the seating structure 406. For the sake of brevity, we have considered the co-ordinates of the user location as the co-ordinates (sox, soy) of the seating structure 406. By way of example, a distance between the user location and the first audio device 408A may be denoted by "d1" and the distance between the user location and the second audio device 408B may be denoted by "d2". The distance between the first audio device 408A and the second audio device 408B may be denoted by "x" (as also described, for example, in FIG. 5A) and the angle between "x" and "d1" may be denoted by "Z". The circuitry 202 may be configured to calculate the co-ordinate (sox, soy) of the user location based on equations (14) and (15), as follows:

$$sox=lx+d1\times\cos(Z) \quad (14)$$

$$soy = ly + d1 \times \sin(Z) \quad (15)$$

$$\text{Where, } Z = \frac{\cos(x^2 + d1^2 - d2^2)}{2 * d1 * x}$$

At a certain time instant, an audio file may be provided to audio channels (5:1 channels) of the audio reproduction system for playback of the audio file by the audio reproduction system 114 (shown in FIG. 1). The circuitry 202 may receive an audio signal from each of the plurality of audio devices 408A-408F, via the audio capturing device 124 (e.g., a mono-microphone) in the user device 120.

The circuitry 202 may be further configured to determine the second distance information (i.e. second distance) between the listening position and each of the plurality of audio devices 408A-408F based on the received audio signals from each of the plurality of audio devices 408A-408F, as described, for example, in FIG. 3 at 316. An example of the second distance information between the listening position and each of the plurality of audio devices 408A-408F is provided in Table 4, as follows:

TABLE 4

Distance measurements for Audio Devices

| Positional Identifier | Distance |
|---|---|
| L | d1 |
| R | d2 |
| SL | d3 |
| SR | d4 |
| C | d5 |

The second distance information may be determined based on the received audio signal. As an example, the second distance information between an audio device of the plurality of audio devices 408A-408F and the listening position may be determined using TOA measurements of the received audio signal. As another example, the distance between the first audio device 408A and the listening position may be determined based on timing signals. The user device 120 may receive a first timing signal from the AVR 410 of the audio reproduction system. The first timing signal may indicate a first time instant at which the audio signal is communicated by the AVR 410 to the first audio device 408A. The audio signal from the first audio device 408A may be recorded at a second time instant by the audio capturing device 124 of the user device 120 at the listening position (such as the user location). An absolute distance (i.e. second distance information) between the first audio device 408A and the user device 120 may be determined based on the first and second time instants. Similarly, the distance between each of the plurality of audio devices 408A-408F and the user location may be determined.

In order to determine an anomaly in connection of one or more audio devices, the circuitry 202 may compare the second distance information (i.e. determined based on the audio signal) with the determined first distance information between the user location and coordinates (i.e. from Table 3) of the plurality of audio devices 408A-408F. Operations for determination of the anomaly are described herein.

In another embodiment, the circuitry 202 may be configured to determine the first distance information between the listening position and the location (as specified in Table 3) of each audio device. The first distance information between the first audio device 408A and the user location may be denoted by "e1" and may be calculated using equation (16), as follows:

$$e1 = \sqrt{(lx - sox)^2 + (ly - soy)^2} \quad (16)$$

Similarly, the first distance information between the second audio device 408B and the user location (sox, soy) may be denoted by "e2" and may be calculated using equation (17), as follows:

$$e1 = \sqrt{(rx - sox)^2 + (ry - soy)^2} \quad (17)$$

The circuitry 202 may be further configured to compare the first distance information with the second distance information (e.g., from Table 4) determined based on the received audio signal. In an embodiment, the first distance information may be determined based on the contour information and the real-dimension information, as described, for example, in FIGS. 3 and 5A. As an example, the circuitry 202 may be configured to compare "d1" with "e1", "d2" with "e2", and the like. In case there is no anomaly in the connection of the first audio device 408A, the first distance information (e1) may be approximately equal to the determined second distance information (d1). The circuitry 202 may determine the anomaly in the connection of first audio device 408A with the AVR 410, if "d1" is not equal to "e1". Similarly, the circuitry 202 may compare (i.e. for inequality) the first distance information (e2, e3, e4 . . . ) and the determined second distance information (d2, d3, d4 . . . ) for other audio devices to determine the anomaly in their respective connections. In certain embodiments, an audio device, for example, the third audio device 408C may not be connected to the AVR 410, and the audio capturing device 124 of the user device 120 may not receive or record the audio signal from the third audio device 408C. In such a case, a Table 5 may be obtained instead of the Table 4, as follows:

TABLE 5

Distance measurements for Audio Devices

| Positional Identifier | Distance |
|---|---|
| L | d1 |
| R | d2 |
| SL | 0 |
| SR | d4 |
| C | d5 |

In case of "d3" being equal to "0", the circuitry 202 may determine the anomaly in the connection of the third audio device 408C as a missing connection.

The circuitry 202 may be further configured to generate connection information associated with the plurality of audio devices 408A-408F based on the determined anomaly. The connection information may include information to indicate whether one or more audio devices are determined to have an incorrect connection or a missing connection with the AVR 410. The circuitry 202 may be further configured to generate the configuration information for calibration of the plurality of audio devices 408A-408F. The configuration information may include a plurality of fine-tuning parameters for the plurality of audio devices 408A-408F. The plurality of fine-tuning parameters may include, but is not limited to, a delay parameter, a level parameter, an EQ parameter, left/right audio device layout, room environment information, or the anomaly in the connection of the one or more audio devices. In an embodiment, the configuration information may be generated based on one or more of, but is not limited to, the determined anomaly in the connection, a layout of the plurality of audio devices in the listening environment, the listening position, and the generated connection information.

In some embodiments, the configuration information may be based on a type of listening environment. For example, if the listening environment is an auditorium, the circuitry 202 may adjust the EQ parameter (i.e. audio parameter) so that the audio content is played with loudness and less bass as a large audience will listen to the audio content. Similarly, if the listening environment is a living room, the circuitry 202 may adjust the EQ parameter (i.e. audio parameter) so that the audio content is played with less loudness and high bass. The circuitry 202 may be further configured to communicate the generated configuration information to the AVR 410 so that the AVR 410 may calibrate the one or more audio devices based on the plurality of fine-tuning parameters.

Figure 8:
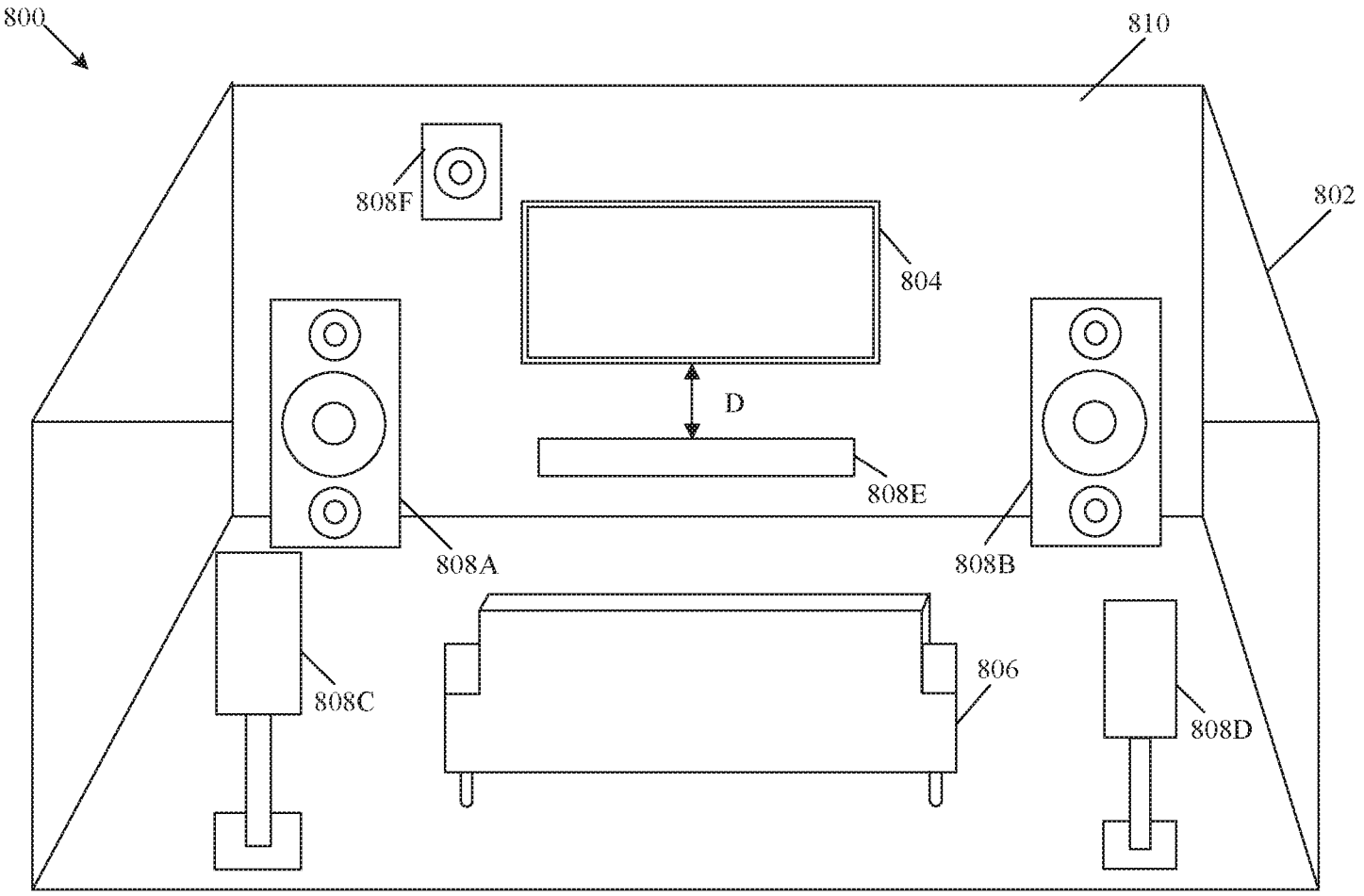
FIG. 8 is diagram that illustrates an exemplary scenario for a layout of objects of an listening environment, in accordance with an embodiment of the disclosure.

FIG. 8 is diagram that illustrates an exemplary scenario for a layout of objects of a listening environment, in accordance with an embodiment of the disclosure. FIG. 8 is explained in conjunction with elements from FIGS. 1, 2, 3, 4, 5A, 5B, 6, and 7. With reference to FIG. 8, there is shown a diagram of an exemplary scenario 800. In the exemplary scenario 800, there is shown an example layout of objects in an example listening environment 802 (hereinafter, "listening environment 802"). The listening environment 802 may include a plurality of objects, such as a display device 804, a seating structure 806, and an audio reproduction system which may include a plurality of audio devices 808A-808F. The audio reproduction system may be a 5:1 surround system, which includes a first audio device 808A, a second audio device 808B, a third audio device 808C, a fourth audio device 808D, a fifth audio device 808E, and the sixth audio device 808F, as the plurality of audio devices 808A-808F.

The display device 804 may be placed on a wall 810 at the center, for example. The seating structure 806 may be at the center of the listening environment 802. The placement of the first audio device 808A, the second audio device 808B, the third audio device 808C, the fourth audio device 808D, the fifth audio device 808E may be with respect to the display device 808 and the seating structure 806. The first audio device 808A may be placed to the left of the display device 804 and may be referred to as a left speaker. Similarly, the second audio device 808B may be placed to the right of the display device 804 and may be referred to as a right speaker. In some embodiments, the first audio device 808A and the second audio device 808B may be spaced apart by equal distance from the display device 804. Additionally, it may be assumed that the first audio device 808A, the second audio device 8088, and the display device 804 lie on a common horizontal line. Also, in some instances, it may be further assumed that the display device 804 is placed at the midpoint of the common horizontal line, with the first audio device 808A and the second audio device 808B at two endpoints of the common horizontal line.

The third audio device 808C may be placed behind the seating structure 806 and to left of the seating structure 806 and may be referred to as a surround left speaker. The fourth audio device 808D may be placed behind the seating structure 806 and to the right of the seating structure 806 and may be referred to as a surround right speaker. The fifth audio device 808E may be placed directly below the display device 804 and may be referred to as a center speaker or a soundbar. As shown in FIG. 8, the sixth audio device 808F may be placed at an elevated height from the height of the display device 804.

The circuitry 202 may be configured to determine a pixel per metrics of the display device 804 based on the height information of the display device 804 and a real-height, indicated in the retrieved real-dimension information, of the display device 804, as described, for example, in FIG. 5A. In an embodiment, heights of at least two audio devices of the plurality of audio devices 808A-808F may be different. For example, a real-height of the third audio device 808C may be different from a real-height of the fourth audio device 808D. The calculation of a height difference between the at least two audio devices, is described for example, in FIG. 9.

The circuitry 202 may be further configured to determine a pixel distance (or pixel difference value) between the display device 804 and the fifth audio device 808E of the plurality of audio devices 808A-808F. The fifth audio device 808E (such as the soundbar) may positioned at a defined distance from the display device 804. The determination of the pixel distance between the display device 804 and the audio device (such as the fifth audio device 808E), is described, for example, in FIG. 5A. The circuitry 202 may be further configured to determine fourth distance information (i.e. absolute distance) between the display device 804 and the fifth audio device 808E based on the determined pixel per metrics and the determined pixel distance. As an example, the fourth distance information "D" may be calculated based on equation (18) as follows:

$$\text{Fourth distance ("}D\text{")} = \text{pixel distance} * \text{pixel per metrics} \tag{18}$$

The circuitry 202 may be further configured to apply a head-related transfer function (HRTF) on the audio device (such as, the fifth audio device 808E) based on the determined fourth distance information. The HRTF may be associated with a particular user (such as the user 122). The HRTF may be determined based on a frequency response of the listening environment 802 and user-specific information corresponding to the particular user. The user-specific information may include at least one of dimensions of a head of the user, dimensions of ears of the user, dimensions of ear canals of the user, dimensions of a shoulder of the user, dimensions of a torso of the user, a density of the head of the user, or an orientation of the head of the user.

In an embodiment, the HRTF may be determined for one or more HRTF filters associated with each of the plurality of audio devices 808A-808F. The circuitry 202 may be configured to determine one or more parameters associated with the one or more HRTF filters, based on the determined listening position and the determined first location information associated with each of the plurality of audio devices 808A-808F (or associated with the fifth audio device 808E that may be positioned at the defined distance "D" from the display device 804). As an example, the HRTF may be determined based on equations (19) and (20), as follows:

$$H_L(r,\theta,\phi,f,a)=P_L(r,\theta,\phi,f,a)/P_0(r,f), \tag{19}$$

$$H_R(r,\theta,\phi,f,a)=P_R(r,\theta,\phi,f,a)/P_0(r,f) \tag{20}$$

where, $H_L$ and $H_R$ represent HRTF functions for left and right ears, respectively, r represents a source distance of an audio device (e.g., the fifth audio device 808E) relative to the head center, θ represents an angle between the listening position and the first location information of the audio device (e.g., the audio device 808E), 0 to 360 degrees, $\phi$ represents an elevation −90 to 90 degrees, below or above, respectively, with respect to the head center, f represents different frequencies, A represents an individual head, $P_L$ and $P_R$ represent sound pressures at left and right ears, respectively, and $P_0$ represents sound pressures at head center with head absent.

The circuitry 202 may be further configured to control the audio reproduction for the fifth audio device 808E (or other audio devices in the listening environment 802) based on the applied HRTF. The application of the HRTF to control the audio reproduction may provide dynamic adjustments to the reproduced audio from the fifth audio device 808E. Therefore, the source of the audio reproduction may appear from the display device 804 instead of the fifth audio device 808E. As a result, the user 122 may feel as if the audio is reproduced directly from the display device 804, rather than from the fifth audio device 808E.

In an embodiment, the circuitry 202 may be configured to identify the HRTF for every point of space in the listening environment 802 with respect to the particular user. Therefore, the disclosed electronic apparatus 102 may control the audio reproduction system to make the reproduced audio appear from a particular point in space of the listening environment 802. The memory 204 may be configured to store the HRTF corresponding to the particular user for every point of space in the listening environment 802. Therefore, with the application of the HRTF, the disclosed electronic apparatus 102 may control the source positions of the audio reproduction in the listening environment 802, with respect to the listening positions of the user 122 (i.e. listener) in the listening environment 802.

In accordance with an embodiment, the circuitry 202 may be configured to determine the elevation angle information (i.e. elevation angle) between the listening position (such as listening position at the seating structure 806) and an audio device (such as the sixth audio device 808F) of the plurality of audio devices 808A-808F. The sixth audio device 808F may be positioned at a defined height from the listening position in the listening environment. The defined height may be above the position of the display device 804 or above the height of the listening position, or above the height of the image-capturing device 104 (not shown in FIG. 8) which captures the image of the listening environment 802.

In an embodiment, to determine the elevation angle information, the circuitry 202 may be configured to determine the first distance information (i.e. absolute distance) between the listening position of the user 122 and the sixth audio device 808F. Similarly, the circuitry 202 may be configured to determine the first distance information (i.e. absolute distance) between the listening position and another audio device (such as the first audio device 808A) of the plurality of audio devices 808A-808F. The first audio device 808A may be positioned at a same height of the listening position in the listening environment. The details of the determination of the first distance information are provided, for example, in FIGS. 3 and 5A. The circuitry 202 may be further configured to determine absolute distance between multiple audio devices (such as between the sixth audio device 808F and the first audio device 808A). The details of the determination of distance (i.e. third distance information) between two audio devices based on pixel distance and pixel per metrics are provided, for example, in FIG. 5A. In accordance with an embodiment, the circuitry 202 may further determine the elevation angle information (i.e. elevation angle) between the listening position (i.e. where the user 122 with user device 120 is positioned) and the sixth audio device 808F based on triangulation, as absolute distances of each side of a triangle (not shown in FIG. 8) is now determined (i.e. the triangle formed between the positions of the listening position, the sixth audio device 808F, and the first audio device 808A). The circuitry 202 may further control the audio reproduction of the sixth audio device 808F based on the determined elevation angle information. For example, the circuitry 202 may control the application of the HRTF on the sixth audio device 808F to control the audio reproduction.

Figure 9:
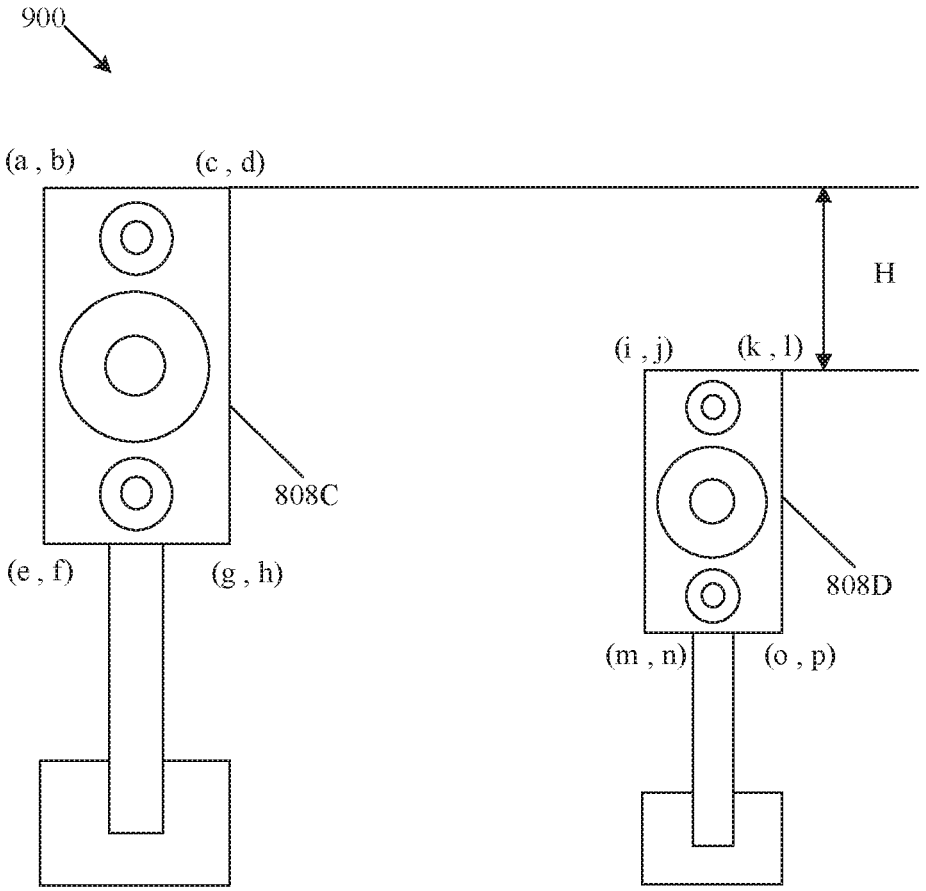
FIG. 9 is diagram that illustrates an exemplary height difference calculation, in accordance with an embodiment of the disclosure.

FIG. 9 is diagram that illustrates an exemplary height difference calculation, in accordance with an embodiment of the disclosure. FIG. 9 is explained in conjunction with elements from FIGS. 1, 2, 3, 4, 5A, 5B, 6, 7, and 8. With reference to FIG. 9, there is shown a diagram of a scenario 900. For the sake of brevity, the scenario 900 includes the calculations to two audio devices (i.e. the third audio device 808C (the surround left speaker) and the fourth audio device 808D (the surround right speaker), also shown in FIG. 8.

In accordance with an embodiment, the circuitry 202 may be further configured to calculate a height difference between the third audio device 808C and the fourth audio device 808D. The height difference may be calculated based on a pixel distance between the one or more audio devices (such as the third audio device 808C and the fourth audio device 808D). The pixel distance may correspond to the pixel difference values between pixel coordinates of the identified audio devices in the captured image (i.e. image 302A shown in FIG. 3). For example, the pixel coordinate of a left top corner of the third audio device 808C is (a, b) and the pixel coordinates of the similar position (i.e. left top corner) of the fourth audio device 808D is (i, j), as shown in FIG. 9. Thus, the circuitry 202 may determine the pixel difference values based on the difference of the pixel coordinates (a, b) and (i, j) of the third audio device 808C and the fourth audio device 808D to determine the height difference. Further, the height difference may be based on the pixel per metrics for the audio device, as described, for example, in FIG. 5A. As an example, the height difference ("D") may be calculated using equation (21), as follows:

$$\text{Height Difference ("}D\text{")} = \text{pixel difference value} * \text{pixel per metrics} \quad (21)$$

The circuitry 202 may be further configured to apply the HRTF on each of the at least two audio devices (such as the third audio device 808C and the fourth audio device 808D) based on the calculated height difference. The circuitry 202 may be further configured to control the audio reproduction from each of the at least two audio devices (such as the third audio device 808C and the fourth audio device 808D) based on the applied HRTF. Therefore, using HRTF, the circuitry 202 may be configured to control the audio reproduction of the third audio device 808C and the fourth audio device 808D (i.e. audio devices of different heights) such that the audio may appear from a particular consistent height in the listening environment 802. Thus, the user 122 (i.e. listener) may experience the audio reproduction from the plurality of audio devices 808A-808F from the consistent height, irrespective of height differences between multiple audio devices in the listening environment 802.

For example, when there is a height difference between the audio devices, the audio experience of the user 122 may be affected. In such a case, the height difference in the plurality of audio devices 808A-808F may be determined using the different pixel coordinates in the captured image 302A, and the HRTF may be applied on each of the plurality of audio devices. Therefore, the circuitry 202 of the disclosed electronic apparatus 102 may be configured to adjust the audio reproduced from the audio reproduction system 114 based on the HRTF. As a result, the adjusted audio reproduced from the audio reproduction system 114 may optimize the audio experience of the user 122.

Figure 10:
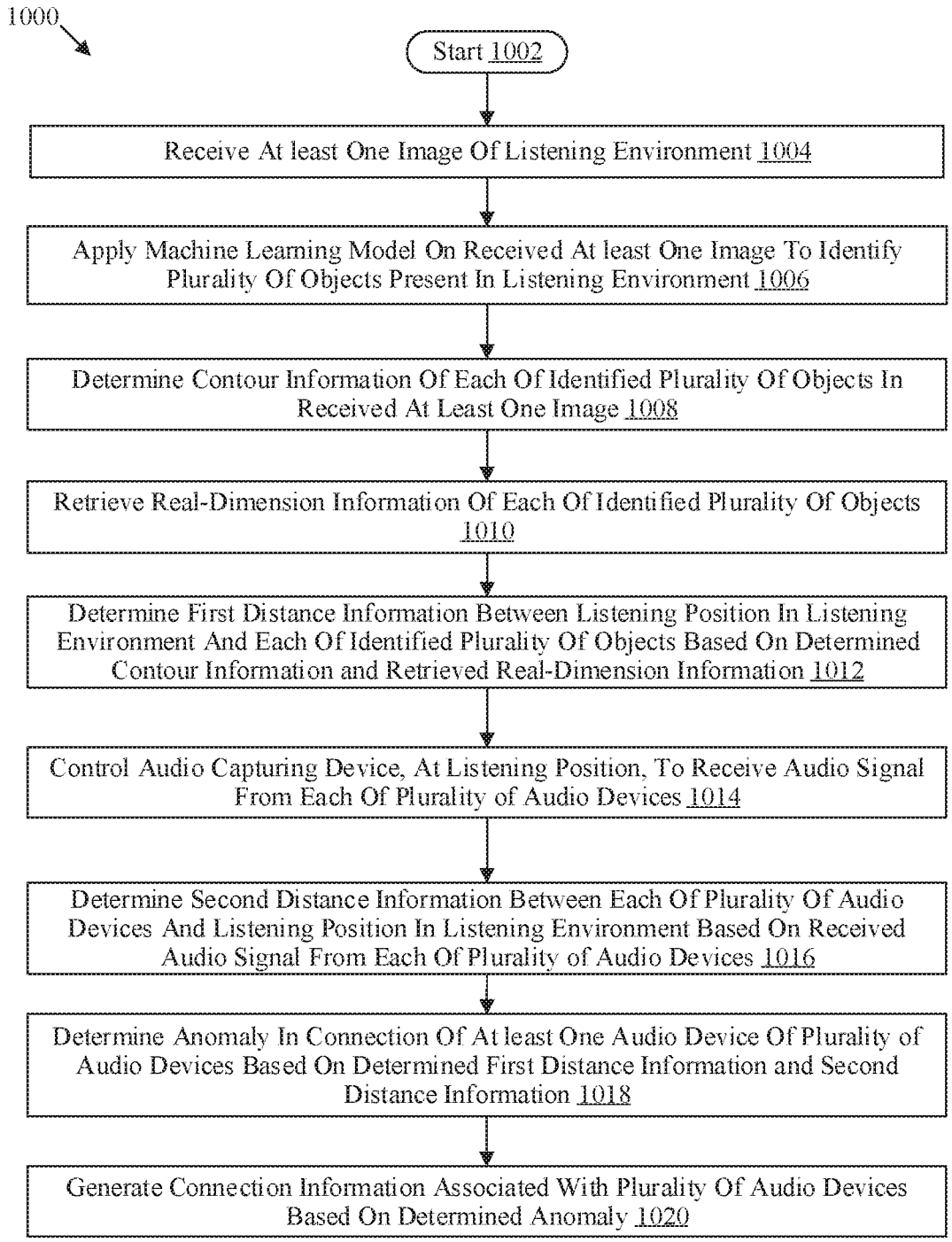
FIG. 10 is a flowchart that illustrates exemplary operations for configuration of an audio reproduction system, in accordance with an embodiment of the disclosure.

FIG. 10 is a flowchart that illustrates exemplary operations for configuration of an audio reproduction system, in accordance with an embodiment of the disclosure. FIG. 10 is explained in conjunction with elements from FIGS. 1, 2, 3, 4, 5A, 5B, 6, 7, 8, and 9. With reference to FIG. 10, there is shown a flowchart 1000. The operations from 1002 to 1020 may be implemented on any computing system, for example, the electronic apparatus 102 or the circuitry 202 of FIG. 2. The operations may start at 1002 and proceed to 1004.

At 1004, at least one image of the listening environment 110 may be received. In one or more embodiments, the circuitry 202 may be configured to receive the at least one image (such as image 302A) of the listening environment 110 from the image-capturing device 104, as described, for example, in FIG. 3 at 302.

At 1006, ML model 126 may be applied on the received at least one image to identify a plurality of objects present in the listening environment 110. In one or more embodiments, the circuitry 202 may be configured to apply the ML model 126 on the received at least one image to identify the plurality of objects present in the listening environment 110. The identified plurality of objects may include the display device 112A and the plurality of audio devices 116A, 116B . . . 116N of the audio reproduction system 114 as described, for example, in FIGS. 1 and 3 at 304.

At 1008, contour information of each of the identified plurality of objects in the received at least one image may be determined. In one or more embodiments, the circuitry 202 may be configured to determine the contour information of each of the identified plurality of objects in the received at least one image. The contour information may include at least one of height information or width information of each of the identified plurality of objects in the received at least one image. Details of the determination of contour information may be described, for example, in FIGS. 3 and 5A.

At 1010, real-dimension information of each of the identified plurality of objects may be retrieved. In one or more embodiments, the circuitry 202 may be configured to retrieve the real-dimension information of each of the identified plurality of objects (such as the plurality of audio devices 116A-116N and the display device 112A), as described, for example, in FIG. 3A at 310.

At 1012, first distance information between a listening position in the listening environment 110 and each of the identified plurality of objects may be determined. In one or more embodiments, the circuitry 202 may be configured to determine the first distance information (i.e. absolute distance) between the listening position in the listening environment 110 and each of the identified plurality of objects (such as the plurality of audio devices 116A-116N and the display device 112A) based on the determined contour information (i.e. height, width, or length information in pixels) and the retrieved real-dimension information (i.e. real height, width, or length) of each of the identified plurality of objects as described, for example, in FIG. 3 (at 312) and FIG. 5A.

At 1014, an audio capturing device may be controlled, at the listening position, to receive an audio signal from each of the plurality of audio devices 116A-116N. In one or more embodiments, the circuitry 202 may be configured to control the audio capturing device 124, at the listening position, to receive the audio signal from each of the plurality of audio devices 116A-116N as described, for example, in FIG. 3 at 316.

At 1016, second distance information between each of the plurality of audio devices 116A-116N and the listening position in the listening environment 110 may be determined. In one or more embodiments, the circuitry 202 may be configured to determine the second distance information (i.e. second distance) between each of the plurality of audio devices 116A-116N and the listening position in the listening environment 110 based on the received audio signal from each of the plurality of audio devices 116A, 116B . . . 116N as described, for example, in FIGS. 3 and 7.

At 1018, an anomaly may be determined. In one or more embodiments, the circuitry 202 may be configured to determine the anomaly in connection of at least one audio device of the plurality of audio devices 116A, 116B . . . 116N based on the determined first distance information and the determined second distance information, as described for example, in FIGS. 3 (at 318) and 7.

At 1020, connection information may be generated. In one or more embodiments, the circuitry 202 may be configured to generate the connection information associated with the plurality of audio devices 116A, 116B . . . 116N based on the determined anomaly as described, for example, in FIGS. 3 and 7. Control may pass to end.

Although the flowchart 1000 is illustrated as discrete operations, such as 1002, 1004, 1006, 1008, 1010, 1012, 1014, 1016, 1018, and 1020, the disclosure is not so limited. Accordingly, in certain embodiments, such discrete operations may be further divided into additional operations, combined into fewer operations, or eliminated, depending on the particular implementation without detracting from the essence of the disclosed embodiments.

Various embodiments of the disclosure may provide a non-transitory computer readable medium and/or storage medium having stored thereon, instructions executable by a machine and/or a computer to operate an electronic apparatus (such as, the electronic apparatus 102). The instructions may cause the machine and/or computer to perform operations that include retrieval of at least one image of a listening environment (such as, the listening environment 110). The operations may further include application of a machine learning (ML) model on the received at least one image to identify a plurality of objects present in the listening environment 110. The plurality of objects may include a display device (such as, the display device 112A) and a plurality of audio devices (such as, the plurality of audio devices 116A-116N) of an audio reproduction system (such as, the audio reproduction system 114). The operations may further include determination of contour information of each of the identified plurality of objects in the received at least one image. The contour information may include at least one of height information or width information of each of the identified plurality of objects in the received at least one image. The operations may further include retrieval of real-dimension information of each of the identified plurality of objects. The operations may further include determination of first distance information between a listening position in the listening environment 110 and each of the identified plurality of objects based on the determined contour information and the retrieved real-dimension information of each of the identified plurality of objects. The operations may further include control an audio capturing device (such as, the audio capturing device 124), at the listening position, to receive an audio signal from each of the plurality of audio devices 116A-116N. The operations may further include determination of second distance information between each of the plurality of audio devices 116A-116N and the listening position in the listening environment 110 based on the received audio signal from each of the plurality of audio devices 116A-116N. The operations may further include determination of an anomaly in connection of at least one audio device of the plurality of audio devices 116A-116N, based on the determined first distance information and the determined second distance information. The operations may further include generation of connection information associated with the plurality of audio devices 116A-116N, based on the determined anomaly.

Exemplary aspects of the disclosure may include an electronic apparatus (such as, the electronic apparatus 102) that may include circuitry (such as, the circuitry 202). The circuitry may be configured to receive at least one image (such as image 302A in FIG. 3) of a listening environment (such as the listening environment 110). The circuitry 202 may be configured to apply a machine learning (ML) model (such as, the ML model 126) on the received at least one image to identify a plurality of objects present in the listening environment. The plurality of objects may include a display device (such as, the display device 112A) and a plurality of audio devices (such as, the plurality of audio devices 116A-116N) of an audio reproduction system (such as, the audio reproduction system 114). The circuitry 202 may be further configured to determine contour information (such as a plurality of contours 308A-308C shown in FIG. 3) of each of the identified plurality of objects in the received at least one image. The contour information may include at least one of height information or width information of each of the identified plurality of objects in the received at least one image. The circuitry 202 may be configured to retrieve real-dimension information of each of the identified plurality of objects and determine first distance information between a listening position in the listening environment 110 and each of the identified plurality of objects based on the determined contour information and the retrieved real-dimension information of each of the identified plurality of objects. The circuitry 202 may be further configured to control an audio capturing device (such as, the audio capturing device 124), at the listening position, to receive an audio signal from each of the plurality of audio devices 116A-116N. The circuitry 202 may be configured to determine second distance information between each of the plurality of audio devices 116A-116N and the listening position in the listening environment 110 based on the received audio signal from each of the plurality of audio devices 116A-116N. Further, the circuitry 202 may be configured to determine an anomaly in connection of at least one audio device of the plurality of audio devices 116A-116N and generate connection information associated with the plurality of audio devices 116A-116N based on the determined anomaly. The determination of the anomaly may be based on the determined first distance information and the determined second distance information.

In accordance with an embodiment, the audio capturing device 124 is a mono-microphone of a user device (such as, the user device 120) located at the listening position in the listening environment 110.

In accordance with an embodiment, the circuitry 202 may be further configured to determine a type of the listening environment 110 based on the received at least one image and the identified plurality of objects and control one or more audio parameters of each of the plurality of audio devices 116A-116N based on the determined type of the listening environment 110.

In accordance with an embodiment, the circuitry 202 may be further configured to determine first location information of each of the plurality of audio devices 116A-116N in the listening environment 110 based on the determined first distance information between the listening position and each of the plurality of audio devices 116A-116N. The circuitry 202 may be further configured to determine second location information of the display device 112A in the listening environment 110 based on the determined first distance information between the listening position and the display device 112A. Based on the determined first location information and the determined second location information, the circuitry 202 may be further configured to identify a layout of the plurality of audio devices 116A-116N in the listening environment 110.

In accordance with an embodiment, the circuitry 202 may be further configured to determine a pixel per metrics for a first audio device (such as, the first audio device 408A) of the plurality of audio devices 408A-408F based on the height information of the first audio device 408A and a real-height, indicated in the retrieved real-dimension information, of the first audio device 408A. The circuitry 202 may be further configured to determine a pixel distance between the first audio device 408A and a second audio device (such as, the second audio device 408B) of the plurality of audio devices 408A-408F. Based on the determined pixel per metrics and the determined pixel distance, the circuitry 202 may be further configured to determine third distance information between the first audio device 408A and the second audio device 408B.

In accordance with an embodiment, the circuitry 202 may be further configured to determine a pixel per metrics of the display device 404 based on the height information of the display device 404 and a real-height, indicated in the retrieved real-dimension information, of the display device 404. The circuitry 202 may be further configured to determine a pixel distance between the display device 404 and an audio device (such as, the fifth audio device 408E) of the plurality of audio devices 408A-408F, wherein the audio device is positioned at a defined distance from the display device 404. Based on the determined pixel per metrics and the determined pixel distance, the circuitry 202 may be further configured to determine fourth distance information between the display device 404 and the audio device. The circuitry 202 may be further configured to apply a head-related transfer function (HRTF) on the audio device based on the determined fourth distance information and control audio reproduction from the audio device based on the applied HRTF.

In accordance with an embodiment, the plurality of audio devices 808A-808F may include an audio device (such as, the sixth audio device 808F in FIG. 8) positioned at a defined height from the listening position in the listening environment. The circuitry 202 may be further configured to determine the first distance information between the listening position and the audio device. The circuitry 202 may be further configured to determine the first distance information between the listening position and another audio device (such as, the first audio device 808A in FIG. 8) positioned at a height of the listening position in the listening environment 402. Based on the determined first distance information related to the audio device (i.e. sixth audio device 808F) and the other audio device (i.e. first audio device 808A), the circuitry 202 may be further configured to determine elevation angle information between the listening position and the audio device (i.e. sixth audio device 808F in FIG. 8).

In accordance with an embodiment, the received at least one image may be captured by an image-capture device (such as, the image-capture device 104) from a first viewpoint (such as, the first viewpoint 128) of the listening environment 110. The circuitry 202 may be further configured to determine the first distance information based on information associated with the image-capture device 104, and wherein the information comprise at least one of a focal length, and a height or a width of a sensor of the image-capture device 104. In accordance with an embodiment, the circuitry 202 may be further configured to determine the first distance information based on a resolution of the received at least one image.

In accordance with an embodiment, the circuitry 202 may be further configured to receive a user input indicative of the listening position in the listening environment 110, on a layout map of the listening environment 110. Based on the received user input, the circuitry 202 may be further configured to determine the listening position in the listening environment 110.

In accordance with an embodiment, the circuitry 202 may be further configured to generate configuration information for calibration of the plurality of audio devices 116A-116N and communicate the generated configuration information to an AVR (such as, the AVR 118) of the audio reproduction system 114. The configuration information may be generated based on one or more of: the determined anomaly in the connection, a layout of the plurality of audio devices 116A-116N in the listening environment 110, the listening position, and the generated connection information. The generated configuration information may include a plurality of fine-tuning parameters, such as, but not limited to, a delay parameter, a level parameter, an EQ parameter, left/right audio device layout, room environment information, or the anomaly in the connection of the one or more audio devices.

In accordance with an embodiment, heights of at least two audio devices of the plurality of audio devices 116A-116N may be different. The circuitry 202 may be further configured to calculate a height difference between the at least two audio devices. The circuitry 202 may be further configured to apply a head-related transfer function (HRTF) on each of the at least two audio devices based on the calculated height difference. Based on the applied HRTF, the circuitry 202 may be further configured to control audio reproduction from each of the at least two audio devices.

The present disclosure may be realized in hardware, or a combination of hardware and software. The present disclosure may be realized in a centralized fashion, in at least one computer system, or in a distributed fashion, where different elements may be spread across several interconnected computer systems. A computer system or other apparatus adapted to carry out the methods described herein may be suited. A combination of hardware and software may be a general-purpose computer system with a computer program that, when loaded and executed, may control the computer system such that it carries out the methods described herein. The present disclosure may be realized in hardware that comprises a portion of an integrated circuit that also performs other functions.

The present disclosure may also be embedded in a computer program product, which comprises all the features that enable the implementation of the methods described herein, and which when loaded in a computer system is able to carry out these methods. Computer program, in the present context, means any expression, in any language, code or notation, of a set of instructions intended to cause a system with information processing capability to perform a particular function either directly, or after either or both of the following: a) conversion to another language, code or notation; b) reproduction in a different material form.

While the present disclosure is described with reference to certain embodiments, it will be understood by those skilled in the art that various changes may be made and equivalents may be substituted without departure from the scope of the present disclosure. In addition, many modifications may be made to adapt a particular situation or material to the teachings of the present disclosure without departure from its scope. Therefore, it is intended that the present disclosure not be limited to the particular embodiment disclosed, but that the present disclosure will include all embodiments that fall within the scope of the appended claims.

What is claimed is:

1. An electronic apparatus, comprising:

circuitry configured to:

receive at least one image of a listening environment;

apply a machine learning (ML) model on the received at least one image to identify a plurality of objects present in the listening environment, wherein the plurality of objects comprises a display device and a plurality of audio devices of an audio reproduction system;

determine contour information of each of the identified plurality of objects in the received at least one image, wherein the contour information comprises at least one of height information or width information of each of the identified plurality of objects in the received at least one image;

retrieve real-dimension information of each of the identified plurality of objects;

determine a pixel per metrics for a first audio device of the plurality of audio devices based on the height information of the first audio device and a real-height, indicated in the retrieved real-dimension information, of the first audio device;

determine first distance information between a listening position in the listening environment and each of the identified plurality of objects based on the determined contour information and the retrieved real-dimension information of each of the identified plurality of objects;

control an audio capturing device, at the listening position, to receive an audio signal from each of the plurality of audio devices;

determine second distance information between each of the plurality of audio devices and the listening position in the listening environment based on the received audio signal from each of the plurality of audio devices;

determine a first pixel distance between the first audio device and a second audio device of the plurality of audio devices;

determine third distance information between the first audio device and the second audio device based on the determined pixel per metrics and the determined first pixel distance;

determine an anomaly in connection of at least one audio device of the plurality of audio devices based on the determined first distance information; the determined second distance information, and the determined third distance information; and generate connection information associated with the plurality of audio devices based on the determined anomaly.

2. The electronic apparatus according to claim 1, wherein the audio capturing device is a mono-microphone of a user device located at the listening position in the listening environment.

3. The electronic apparatus according to claim 1, wherein the circuitry is further configured to:

determine a type of the listening environment based on the received at least one image and the identified plurality of objects; and control at least one audio parameter of each of the plurality of audio devices based on the determined type of the listening environment.

4. The electronic apparatus according to claim 1, wherein the circuitry is further configured to:

determine first location information of each of the plurality of audio devices in the listening environment based on the determined first distance information between the listening position and each of the plurality of audio devices;

determine second location information of the display device in the listening environment based on the determined first distance information between the listening position and the display device; and identify a layout of the plurality of audio devices in the listening environment based on the determined first location information and the determined second location information.

5. The electronic apparatus according to claim 1, wherein the circuitry is further configured to:

determine a pixel per metrics of the display device based on the height information of the display device and a real-height, indicated in the retrieved real-dimension information, of the display device;

determine a second pixel distance between the display device and a third audio device of the plurality of audio devices, wherein the third audio device is positioned at a defined distance from the display device;

determine fourth distance information between the display device and the third audio device based on the determined pixel per metrics of the display device and the determined second pixel distance;

apply a head-related transfer function (HRTF) on the third audio device based on the determined fourth distance information; and control audio reproduction from the third audio device based on the applied HRTF.

6. The electronic apparatus according to claim 1, wherein the plurality of audio devices include a fourth audio device positioned at a defined height from the listening position in the listening environment, and the circuitry is further configured to:

determine the first distance information between the listening position and the fourth audio device;

determine the first distance information between the listening position and a fifth audio device positioned at a height of the listening position in the listening environment; and determine elevation angle information between the listening position and the fourth audio device based on the determined first distance information related to the fourth audio device and the fifth audio device.

7. The electronic apparatus according to claim 1, wherein the received at least one image is captured by an image-capture device from a first viewpoint of the listening environment.

8. The electronic apparatus according to claim 7, wherein the circuitry is further configured to determine the first distance information based on information associated with the image-capture device, and the information comprise at least one of a focal length, and a height or a width of a sensor of the image-capture device.

9. The electronic apparatus according to claim 1, wherein the circuitry is further configured to determine the first distance information based on a resolution of the received at least one image.

10. The electronic apparatus according to claim 1, wherein the circuitry is further configured to:

receive a user input on a layout map of the listening environment, wherein the user input is indicative of the listening position in the listening environment; and determine the listening position in the listening environment based on the received user input.

11. The electronic apparatus according to claim 1, wherein the circuitry is further configured to:

generate configuration information for calibration of the plurality of audio devices based on at least one of the determined anomaly in the connection, a layout of the plurality of audio devices in the listening environment, the listening position, or the generated connection information; and communicate the generated configuration information to an audio-video receiver (AVR) of the audio reproduction system.

12. The electronic apparatus according to claim 11, wherein the generated configuration information comprises a plurality of fine-tuning parameters, and wherein the plurality of fine-tuning parameters comprises a delay parameter, a level parameter, an equalization (EQ) parameter, left/right audio device layout, room environment information, or the anomaly in the connection of the at least one audio device.

13. The electronic apparatus according to claim 1, wherein heights of at least two audio devices of the plurality of audio devices are different.

14. The electronic apparatus according to claim 13, wherein the circuitry is further configured to:

calculate a height difference between the at least two audio devices;

apply a head-related transfer function (HRTF) on each of the at least two audio devices based on the calculated height difference; and control audio reproduction from each of the at least two audio devices based on the applied HRTF.

15. A method, comprising:

in an electronic apparatus:

receiving at least one image of a listening environment;

applying a machine learning (ML) model on the received at least one image to identify a plurality of objects present in the listening environment, wherein the plurality of objects comprises a display device and a plurality of audio devices of an audio reproduction system;

determining contour information of each of the identified plurality of objects in the received at least one image, wherein the contour information comprises at least one of height information or width information of each of the identified plurality of objects in the received at least one image;

retrieving real-dimension information of each of the identified plurality of objects;

determining a pixel per metrics for a first audio device of the plurality of audio devices based on the height information of the first audio device and a real-height, indicated in the retrieved real-dimension information, of the first audio device;

determining first distance information between a listening position in the listening environment and each of the identified plurality of objects based on the determined contour information and the retrieved real-dimension information of each of the identified plurality of objects;

controlling an audio capturing device, at the listening position, to receive an audio signal from each of the plurality of audio devices;

determining second distance information between each of the plurality of audio devices and the listening position in the listening environment based on the received audio signal from each of the plurality of audio devices;

determining a pixel distance between the first audio device and a second audio device of the plurality of audio devices;

determining third distance information between the first audio device and the second audio device based on the determined pixel per metrics and the determined pixel distance;

determining an anomaly in connection of at least one audio device of the plurality of audio devices based on the determined first distance information, the determined second distance information, and the determined third distance information; and generating connection information associated with the plurality of audio devices based on the determined anomaly.

16. The method according to claim 15, wherein the first distance information is determined based on information associated with an image-capture device which captures the at least one image of the listening environment, and the information comprise at least one of a focal length, and a height or a width of a sensor of the image-capture device.

17. The method according to claim 15, further comprising:

calculating a height difference between at least two audio devices of the plurality of audio devices;

applying a head-related transfer function (HRTF) on each of the at least two audio devices based on the calculated height difference; and controlling audio reproduction from each of the at least two audio devices based on the applied HRTF.

18. A non-transitory computer-readable medium having stored thereon, computer-executable instructions that when executed by an electronic apparatus, causes the electronic apparatus to execute operations, the operations comprising:

receiving at least one image of a listening environment;

applying a machine learning (ML) model on the received at least one image to identify a plurality of objects present in the listening environment, wherein the plurality of objects comprises a display device and a plurality of audio devices of an audio reproduction system;

determining contour information of each of the identified plurality of objects in the received at least one image, wherein the contour information comprises at least one of height information or width information of each of the identified plurality of objects in the received at least one image;

retrieving real-dimension information of each of the identified plurality of objects;

determine a pixel per metrics for a first audio device of the plurality of audio devices based on the height information of the first audio device and a real-height, indicated in the retrieved real-dimension information, of the first audio device;

determining first distance information between a listening position in the listening environment and each of the identified plurality of objects based on the determined contour information and the retrieved real-dimension information of each of the identified plurality of objects;

controlling an audio capturing device, at the listening position, to receive an audio signal from each of the plurality of audio devices;

determining second distance information between each of the plurality of audio devices and the listening position in the listening environment based on the received audio signal from each of the plurality of audio devices;

determine a pixel distance between the first audio device and a second audio device of the plurality of audio devices;

determine third distance information between the first audio device and the second audio device based on the determined pixel per metrics and the determined pixel distance;

determining an anomaly in connection of at least one audio device of the plurality of audio devices based on the determined first distance information, the determined second distance information, and the determined third distance information; and generating connection information associated with the plurality of audio devices based on the determined anomaly.

* * * * *